US012599173B2

(12) United States Patent
Rothwell et al.

(10) Patent No.: US 12,599,173 B2
(45) Date of Patent: Apr. 14, 2026

(54) REFILLING APPARATUS

(71) Applicant: Nicoventures Trading Limited, London (GB)

(72) Inventors: Howard Rothwell, London (GB); My-Linh Tran, London (GB); Stephen Potter, London (GB); Robert Kersey, London (GB); Tomi Vintola, London (GB)

(73) Assignee: Nicoventures Trading Limited (GB)

( * ) Notice: Subject to any disclaimer, the term of this patent is extended or adjusted under 35 U.S.C. 154(b) by 96 days.

(21) Appl. No.: 18/576,985

(22) PCT Filed: Jul. 1, 2022

(86) PCT No.: PCT/GB2022/051702
§ 371 (c)(1),
(2) Date: Jan. 5, 2024

(87) PCT Pub. No.: WO2023/281246
PCT Pub. Date: Jan. 12, 2023

(65) Prior Publication Data

US 2025/0082016 A1 Mar. 13, 2025

(30) Foreign Application Priority Data

Jul. 5, 2021 (GB) ..... 2109697
Sep. 3, 2021 (GB) ..... 2112578

(51) Int. Cl.
*A24F 40/40* (2020.01)
*A24F 40/10* (2020.01)
(Continued)

(52) U.S. Cl.
CPC ..... *A24F 40/42* (2020.01); *A24F 40/10* (2020.01); *A24F 40/53* (2020.01); *A24F 40/60* (2020.01)

(58) Field of Classification Search
CPC ..... A24F 40/40; A24F 40/42; A24F 40/50
See application file for complete search history.

(56) References Cited

U.S. PATENT DOCUMENTS

2015/0245654 A1 9/2015 Memari et al.
2016/0325858 A1 11/2016 Ampolini et al.
(Continued)

FOREIGN PATENT DOCUMENTS

WO 2017037457 A1 3/2017
WO 2020074929 A1 4/2020

OTHER PUBLICATIONS

PCT International Search Report and Written Opinion in International Appln. No. PCT/GB2022/051702, dated Oct. 26, 2022, 20 pages.

*Primary Examiner* — Paul J Gray
(74) *Attorney, Agent, or Firm* — Merchant & Gould P.C.

(57) ABSTRACT

A refilling unit for refilling a refillable article for use with an aerosol provision device for generating aerosol from aerosol-generating material stored within the refillable article, the refilling unit including: an article port for receiving at least the article; an information reader configured to read a readable element for storing information corresponding to the article; and a controller for controlling operations of the refilling unit, wherein the controller is configured to: determine or obtain an actual usage of the article based on an indication of usage of the article read from the readable element; determine or obtain an expected usage of the article; and compare the actual usage with the expected usage and, if the actual usage is within a predetermined range of the expected usage, permit the refilling unit to refill the article with aerosol-generating material. Also described is an article, aerosol provision device, system and method.

16 Claims, 10 Drawing Sheets

(51) Int. Cl.

| | |
|---|---|
| ***A24F 40/42*** | (2020.01) |
| ***A24F 40/53*** | (2020.01) |
| ***A24F 40/60*** | (2020.01) |

(56) References Cited

U.S. PATENT DOCUMENTS

| | | | | |
|---|---|---|---|---|
| 2017/0042214 | A1 | 2/2017 | Murison | |
| 2017/0258136 | A1 | 9/2017 | Hawes et al. | |
| 2018/0029866 | A1 | 2/2018 | Scott et al. | |
| 2018/0257797 | A1 | 9/2018 | Beer | |
| 2019/0166913 | A1 | 6/2019 | Trzecieski | |
| 2020/0022416 | A1 | 1/2020 | Alarcon | |
| 2020/0060342 | A1 | 2/2020 | Woodbine et al. | |
| 2020/0189903 | A1 | 6/2020 | Madera et al. | |
| 2021/0337878 | A1* | 11/2021 | Gretton | A24F 40/44 |

* cited by examiner

REFILLING APPARATUS

RELATED APPLICATIONS

The present application is a National Phase entry of PCT Application No. PCT/GB2022/051702 filed Jul. 1, 2022, which claims priority to GB Application No. 2109697.9 filed Jul. 5, 2021 and GB Application No. 2112578.6 filed Sep. 3, 2021, each of which is hereby incorporated by reference in their entirety.

TECHNICAL FIELD

The present disclosure relates to an apparatus for refilling a reservoir of an electronic aerosol provision system and more specifically to the operation of an apparatus for refilling a reservoir of an electronic aerosol provision system.

The present disclosure relates to a system including a docking unit for docking with an electronic aerosol provision system, and more specifically relates to the operation of the system.

BACKGROUND

Electronic aerosol provision systems, which are often configured as so-called electronic cigarettes, can have a unitary format with all elements of the system in a common housing, or a multi-component format in which elements are distributed between two or more housings which can be coupled together to form the system. A common example of the latter format is a two-component system comprising a device and an article. The device typically contains an electrical power source for the system, such as a battery, and control electronics for operating elements in order to generate aerosol. The article, also referred to by terms including cartridge, cartomiser, consumable and clearomiser, typically contains a storage volume or area for holding a supply of aerosol-generating material from which the aerosol is generated, and in some instances an aerosol generator such as a heater operable to vaporize the aerosol-generating material. A similar three-component system may include a separate mouthpiece that attaches to the article. In many designs, the article is designed to be disposable, in that it is intended to be detached from the device and thrown away when the aerosol-generating material has been consumed. The user obtains a new article which has been prefilled with aerosol-generating material by a manufacturer and attaches it to the device for use. The device, in contrast, is intended to be used with multiple consecutive articles, with a capability to recharge the battery to allow prolonged operation.

While disposable articles, which may be called consumables, are convenient for the user, they may be considered wasteful of natural resources and hence detrimental to the environment. An alternative design of article is therefore known, which is configured to be refilled with aerosol-generating material by the user. This reduces waste, and can reduce the cost of electronic cigarette usage for the user. The aerosol-generating material may be provided in a bottle, for example, from which the user squeezes or drips a quantity of material into the article via a refilling orifice on the article. However, the act of refilling can be awkward and inconvenient, since the items are small and the volume of material involved is typically low. Alignment of the juncture between bottle and article can be difficult, with inaccuracies leading to spillage of the material. This is not only wasteful, but may also be dangerous. Aerosol-generating material frequently contains liquid nicotine, which can be poisonous if it makes contact with the skin.

Therefore, refilling units or devices have been proposed, which are configured to receive a bottle or other reservoir of aerosol-generating material plus a refillable cartridge, and to automate the transfer of the material from the former to the latter. Alternative, improved or enhanced features and designs for such refilling devices are therefore of interest.

Additionally, such systems designed to included refillable consumables may be subject to abuse, in that aerosol-generating material that is either not designed for use with such consumables or does not comply with local/worldwide regulations may be inserted into the consumables. The use of the consumable in such instances may cause damage to aspects of the system and/or in certain instances cause harm to a user. Alternative, improved or enhanced features and designs for such refilling devices are therefore of interest.

SUMMARY

According to a first aspect of certain embodiments there is provided a refilling unit for refilling a refillable article for use with an aerosol provision device for generating aerosol from aerosol-generating material stored within the refillable article, the refilling unit including: an article port for receiving at least the article; an information reader configured to read a readable element for storing information corresponding to the article; and a controller for controlling operations of the refilling unit, wherein the controller is configured to: determine or obtain an actual usage of the article based on an indication of usage of the article read from the readable element of the article; determine or obtain an expected usage of the article; and compare the actual usage with the expected usage and, if the actual usage is within a predetermined range of the expected usage, permit the refilling unit to refill the article with aerosol-generating material.

According to a second aspect of certain embodiments there is provided a refillable article for use with an aerosol provision device for generating aerosol from aerosol-generating material stored within the refillable article, the refillable article including: a storage area for storing aerosol-generating material; a readable element for storing information corresponding to the article; and an indication of usage of the article stored in the readable element, wherein the indication of usage is indicative of the amount of aerosol-generating material aerosolized by the article since a previous filling or refilling operation in which the article is supplied with aerosol-generating material.

According to a third aspect of certain embodiments there is provided a system including the refilling unit of the first aspect and a refillable article of the second aspect, wherein the refillable article is configured to releasably engage with the refilling unit.

According to a fourth aspect of certain embodiments there is provided aerosol provision device for use with a refillable article for generating aerosol from aerosol-generating material stored within the article, the device including: a power source for supplying power to cause aerosolization of aerosol-generating material within the article; and a controller for controlling aspects of operation of the aerosol provision device, wherein the controller is configured to update an indication of usage of the article indicative of the amount of aerosol-generating material aerosolized by the article since a previous filling or refilling operation in which the article is supplied with aerosol-generating material stored by a readable element of the article.

According to a fifth aspect of certain embodiments there is provided system comprising the refillable article of the second aspect and the aerosol provision device of the fourth aspect, wherein the refillable article is configured to releasably engage with the aerosol provision device.

According to a sixth aspect of certain embodiments there is provided a method for refilling a refillable article for use with an aerosol provision device for generating aerosol from aerosol-generating material stored within the refillable article using a refilling unit, the method including: determining or obtaining an actual usage of the article based on information from the article; determining or obtaining an expected usage of the article; and comparing the actual usage with the expected usage and, if the actual usage is within a predetermined range of the expected usage, permitting the refilling unit to refill the article with aerosol-generating material.

According to a seventh aspect of certain embodiments there is provided refilling means for refilling a refillable article for use with an aerosol provision device for generating aerosol from aerosol-generating material stored within the refillable article, the refilling means including: receiving means for receiving at least the article; reading means configured to read a readable element for storing information corresponding to the article; and controller means for controlling operations of the refilling means, wherein the controller means is configured to: determine or obtain an actual usage of the article based on an indication of usage of the article read from the readable element of the article; determine or obtain an expected usage of the article; and compare the actual usage with the expected usage and, if the actual usage is within a predetermined range of the expected usage, permit the refilling unit to refill the article with aerosol-generating material.

According to an eighth aspect of certain embodiments there is provided a system comprising: an aerosol provision device for generating aerosol from aerosol-generating material; a docking unit for engaging with the aerosol provision device, the docking unit arranged to at least one of: refill an article containing aerosol generating material for use with the aerosol provision device, and recharge a power source of the aerosol provision device, and a controller arranged to obtain status information regarding the status of the docking unit, wherein the aerosol provision device comprises a feedback mechanism arranged to provide feedback to a user; and the controller is configured to cause the feedback mechanism of the aerosol provision device to provide feedback to the user indicative of the status of the docking unit.

According to a ninth aspect of certain embodiments there is provided an aerosol provision device for generating aerosol from aerosol-generating material, the aerosol provision device comprising a feedback mechanism arranged to provide feedback to a use, wherein the aerosol provision device is configured to engage with a docking unit, the docking unit arranged to at least one of: refill an article containing aerosol generating material for use with the aerosol provision device, and recharge a power source of the aerosol provision device, and wherein the feedback mechanism of the aerosol provision device is configured to provide feedback to the user indicative of the status of the docking unit on the basis of obtained status information regarding the status of the docking unit.

According to a tenth aspect of certain embodiments there is provided a docking unit for engaging with an aerosol provision device for generating aerosol from aerosol-generating material, wherein the docking unit is arranged to at least one of: refill an article containing aerosol generating material for use with the aerosol provision device, and recharge a power source of the aerosol provision device, and wherein the docking unit is configured to generate status information regarding the status of the docking unit, wherein the status information is for causing the feedback mechanism of the aerosol provision device to provide feedback to the user indicative of the status of the docking unit.

According to an eleventh aspect of certain embodiments there is provided a method of displaying feedback to a user, the feedback indicative of a status of a docking unit configured to engage with an aerosol provision device for generating aerosol from aerosol-generating material, the docking unit arranged to at least one of: refill an article containing aerosol generating material for use with the aerosol provision device, and recharge a power source of the aerosol provision device, the method comprising: engaging the aerosol provision device with the docking unit; obtaining status information regarding the status of the docking unit; and causing a feedback mechanism of the aerosol provision device to provide feedback to the user indicative of the status of the docking unit.

According to a twelfth aspect of certain embodiments there is provided a system comprising an aerosol provision device for generating aerosol from aerosol-generating material and a docking unit for engaging with the aerosol provision device, the docking unit arranged to at least refill an article containing aerosol generating material for use with the aerosol provision device and/or recharge a power source of the aerosol provision device, wherein: the aerosol provision device comprises a docking unit engagement mechanism for engaging with the docking unit; the docking unit comprises an aerosol provision device engagement mechanism for engaging with the aerosol provision device; and at least one of the docking unit engagement mechanism and aerosol provision device engagement mechanism are configured to enable the aerosol provision device to be engaged with the docking unit in a single orientation.

According to a thirteenth aspect of certain embodiments there is provided a docking unit for engaging with an aerosol provision device for generating aerosol from aerosol-generating material, the docking unit arranged to at least refill an article containing aerosol generating material for use with the aerosol provision device and/or recharge a power source of the aerosol provision device, wherein: the docking unit comprises an aerosol provision device engagement mechanism for engaging with the aerosol provision device; and the docking unit engagement mechanism is configured to enable the aerosol provision device to be engaged with the docking unit in a single orientation.

According to a fourteenth aspect of certain embodiments there is provided an aerosol provision device for generating aerosol from aerosol-generating material, the aerosol provision device comprising a docking unit engagement mechanism for engaging with a docking unit, the docking unit arranged to at least refill an article containing aerosol generating material for use with the aerosol provision device and/or recharge a power source of the aerosol provision device, wherein: the docking unit engagement mechanism is configured to enable the aerosol provision device to be engaged with the docking unit in a single orientation.

According to a fifteenth aspect of certain embodiments there is provided a method of engaging an aerosol provision device for generating aerosol from aerosol-generating material with a docking unit, for engaging with the aerosol provision device, the docking unit arranged to at least refill an article containing aerosol generating material for use with the aerosol provision device and/or recharge a power source of the aerosol provision device, the method comprising: engaging a docking unit engagement mechanism of the aerosol provision device with an aerosol provision device engagement mechanism of the docking unit; wherein at least one of the docking unit engagement mechanism and aerosol provision device engagement mechanism are configured to enable the aerosol provision device to be engaged with the docking unit in a single orientation.

According to a sixteenth aspect of certain embodiments there is provided a system comprising: aerosol provision means for generating aerosol from aerosol-generating material; docking means for engaging with the aerosol provision means, the docking means arranged to at least one of: refill an article containing aerosol generating material for use with the aerosol provision means, and recharge a power source of the aerosol provision means, and controller means arranged to obtain status information regarding the status of the docking means, wherein the aerosol provision means comprises feedback means arranged to provide feedback to a user; and the controller means is configured to cause the feedback means of the aerosol provision means to provide feedback to the user indicative of the status of the docking means.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein.

BRIEF DESCRIPTION OF THE DRAWINGS

Various embodiments of the invention will now be described in detail by way of example only with reference to the following drawings in which:

FIG. 10A shows the feedback mechanism in a state where the aerosol provision device is not engaged with the docking unit and FIG. 10B shows the feedback mechanism in a state where the aerosol provision device is engaged with the docking unit;

DETAILED DESCRIPTION

Figure 1:
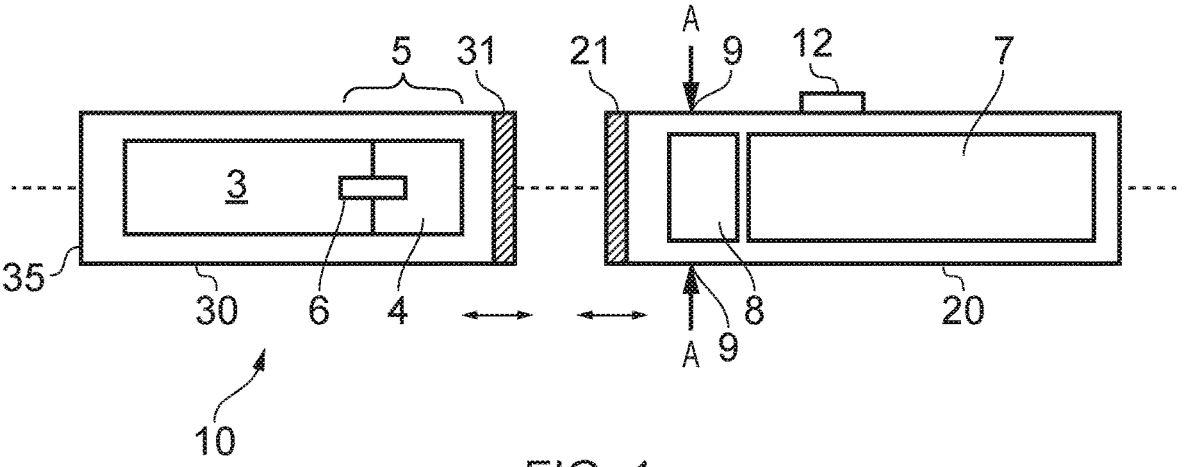
FIG. 1 shows a simplified schematic cross-section through an example electronic aerosol provision system to which embodiments of the present disclosure are applicable.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapour provision systems, such as e-cigarettes. Throughout the following description the terms "e-cigarette" and "electronic cigarette" may sometimes be used; however, it will be appreciated these terms may be used interchangeably with aerosol (vapour) provision system or device. The systems are intended to generate an inhalable aerosol by vaporization of a substrate (aerosol-generating material) in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The terms "aerosol-generating material" and "aerosolizable material" as used herein are intended to refer to materials which can form an aerosol, either through the application of heat or some other means. The term "aerosol" may be used interchangeably with "vapour".

As used herein, the terms "system" and "delivery system" are intended to encompass systems that deliver a substance to a user, and include non-combustible aerosol provision systems that release compounds from an aerosol-generating material without combusting the aerosol-generating material, such as electronic cigarettes, tobacco heating products, and hybrid systems to generate aerosol using a combination of aerosol-generating materials, and articles comprising aerosol-generating material and configured to be used within one of these non-combustible aerosol provision systems.

According to the present disclosure, a "non-combustible" aerosol provision system is one where a constituent aerosol-generating material of the aerosol provision system (or component thereof) is not combusted or burned in order to facilitate delivery of at least one substance of the aerosol-generating material to a user. In some embodiments, the delivery system is a non-combustible aerosol provision system, such as a powered non-combustible aerosol provision system. In some embodiments, the non-combustible aerosol provision system is an electronic cigarette, also known as a vaping device or electronic nicotine delivery (END) system, although it is noted that the presence of nicotine in the aerosol-generating material is not a requirement. In some embodiments, the non-combustible aerosol provision system is an aerosol-generating material heating system, also known as a heat-not-burn system. An example of such a system is a tobacco heating system. In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol generating material and a solid aerosol generating material. The solid aerosol generating material may comprise, for example, tobacco or a non-tobacco product.

Typically, the non-combustible aerosol provision system may comprise a non-combustible aerosol provision device and an article (consumable) for use with the non-combustible aerosol provision device. In some embodiments, the disclosure relates to consumables comprising aerosol-generating material and configured to be used with non-combustible aerosol provision devices. These consumables are sometimes referred to as articles throughout the disclosure. However, it is envisaged that articles which themselves comprise a means for powering an aerosol generator or aerosol generating component may themselves form the non-combustible aerosol provision system. In some embodiments, the non-combustible aerosol provision device may comprise a power source and a controller. The power source may, for example, be an electric power source. In some embodiments, the article for use with the non-combustible aerosol provision device may comprise an aerosol-generating material, an aerosol-generating component (aerosol generator), an aerosol-generating area, a mouthpiece, and/or an area for receiving and holding aerosol-generating material.

In some systems the aerosol-generating component or aerosol generator comprises a heater capable of interacting with the aerosol-generating material so as to release one or more volatiles from the aerosol-generating material to form an aerosol. However, the disclosure is not limited in this regard, and applies also to systems that use other approaches to form aerosol, such as a vibrating mesh.

In some embodiments, the article for use with the non-combustible aerosol provision device may comprise aerosol-generating material or an area for receiving aerosol-generating material. In some embodiments, the article for use with the non-combustible aerosol provision device may comprise a mouthpiece. The area for receiving aerosol-generating material may be a storage area for storing aerosol-generating material. For example, the storage area may be a reservoir which may store a liquid aerosol-generating material. In some embodiments, the area for receiving aerosol-generating material may be separate from, or combined with, an aerosol generating area (which is an area at which the aerosol is generated). In some embodiments, the article for use with the non-combustible aerosol provision device may comprise a filter and/or an aerosol-modifying agent through which generated aerosol is passed before being delivered to the user.

As used herein, the term "component" may be used to refer to a part, section, unit, module, assembly or similar of an electronic cigarette or similar device that incorporates several smaller parts or elements, possibly within an exterior housing or wall. An aerosol provision system such as an electronic cigarette may be formed or built from one or more such components, such as an article and a device, and the components may be removably or separably connectable to one another, or may be permanently joined together during manufacture to define the whole system. The present disclosure is applicable to (but not limited to) systems comprising two components separably connectable to one another and configured, for example, as an article in the form of an aerosol-generating material carrying component holding liquid or another aerosol-generating material (alternatively referred to as a cartridge, cartomiser, pod or consumable), and a device having a battery or other power source for providing electrical power to operate an aerosol generating component or aerosol generator for creating vapour/aerosol from the aerosol-generating material. A component may include more or fewer parts than those included in the examples.

In some examples, the present disclosure relates to aerosol provision systems and components thereof that utilise aerosol-generating material in the form of a liquid, gel or a solid which is held in an aerosol-generating material storage area such as a reservoir, tank, container or other receptacle comprised in the system, or absorbed onto a carrier substrate. An arrangement for delivering the aerosol-generating material from the aerosol-generating material storage area for the purpose of providing it to an aerosol generator for vapour/aerosol generation is included. The terms "liquid", "gel", "solid", "fluid", "source liquid", "source gel", "source fluid" and the like may be used interchangeably with terms such as "aerosol-generating material", "aerosolizable substrate material" and "substrate material" to refer to material that has a form capable of being stored and delivered in accordance with examples of the present disclosure.

As used herein, "aerosol-generating material" is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid. In some embodiments, the aerosol-generating material may comprise one or more active constituents, one or more flavors, one or more aerosol-former materials, and/or one or more other functional materials. The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, thiene, vitamins such as B6 or B12 or C, melatonin, cannabinoids, or constituents, derivatives, or combinations thereof. The active substance may comprise one or more constituents, derivatives or extracts of tobacco, *Cannabis* or another botanical. As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof. The aerosol-former material may comprise one or more constituents capable of forming an aerosol. In some embodiments, the aerosol-former material may comprise one or more of glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate. The one or more other functional materials may comprise one or more of pH regulators, coloring agents, preservatives, binders, fillers, stabilizers, and/or antioxidants.

FIG. 1 is a highly schematic diagram (not to scale) of an electronic aerosol/vapour provision system 10, presented for the purpose of showing the relationship between the various parts of a typical system and explaining the general principles of operation. Note that the present disclosure is not limited to a system configured in this way, and features may be modified in accordance with the various alternatives and definitions described above and/or apparent to the skilled person.

The aerosol provision system 10 has a generally elongate shape in this example, extending along a longitudinal axis indicated by a dashed line, and comprises two main components, namely an aerosol provision device 20 (control or power component, section or unit), and an article or consumable 30 (cartridge assembly or section, sometimes referred to as a cartomiser, clearomiser or pod) carrying aerosol-generating material and operable to generate vapour/aerosol. In the following description, the aerosol provision system 10 is configured to generate aerosol from a liquid aerosol-generating material (otherwise referred to as a source liquid), and the foregoing disclosure will explain the principles of the present disclosure using this example. However, the present disclosure is not limited to aerosolizing a liquid aerosol-generating material, and features may be modified in accordance with the various alternatives and definitions described above and/or apparent to the skilled person in order to aerosolize different aerosol-generating materials, e.g., solid aerosol-generating materials or gel aerosol-generating materials as described above.

The article 30 includes a reservoir 3 (as an example of an aerosol-generating material storage area) for containing a source liquid from which an aerosol is to be generated, for example containing nicotine. As an example, the source liquid may comprise around 1% to 3% nicotine and 50% glycerol, with the remainder comprising roughly equal measures of water and propylene glycol, and possibly also comprising other components, such as flavorings. Nicotine-free source liquid may also be used, such as to deliver flavoring. In some other embodiments, a solid substrate (not illustrated), such as a portion of tobacco or other flavor imparting element through which vapour generated from the source liquid is passed, may also be included. The reservoir 3 may have the form of a storage tank, being a container or receptacle in which source liquid can be stored such that the liquid is free to move and flow within the confines of the tank. In other examples, the storage area may comprise absorbent material (either inside a tank or similar, or positioned within the outer housing of the article) that substantially holds the aerosol-generating material. For a consumable article, the reservoir 3 may be sealed after filling during manufacture so as to be disposable after the source liquid is consumed. However, the present disclosure is relevant to refillable articles that have an inlet port, orifice or other opening (not shown in FIG. 1) through which new source liquid can be added to enable reuse of the article 30.

The article 30 also comprises an aerosol generator 5, which may have the form of an electrically powered heating element or heater 4 and an aerosol-generating material transfer component 6 designed to transfer aerosol-generating material from the aerosol-generating material storage area to the aerosol generator). The heater 4 is located externally of the reservoir 3 and is operable to generate the aerosol by vaporization of the source liquid by heating. The aerosol-generating material transfer component 6 is a transfer or delivery arrangement configured to deliver aerosol-generating material from the reservoir 3 to the heater 4. In some examples, it may have the form of a wick or other porous element. A wick 6 may have one or more parts located inside the reservoir 3, or otherwise be in fluid communication with liquid in the reservoir 3, so as to be able to absorb source liquid (in the reservoir 3) and transfer it by wicking or capillary action to other parts of the wick 6 that are adjacent or in contact with the heater 4. The wick 6 may be formed of any suitable material which can cause wicking of the liquid, such as glass fibres or cotton fibres. This wicked liquid is thereby heated and vaporized, and replacement liquid is drawn, via continuous capillary action, from the reservoir 3 for transfer to the heater 4 by the wick 6. The wick 6 may be thought of as a conduit between the reservoir 3 and the heater 4 that delivers or transfers liquid from the reservoir to the heater. In some implementations, the heater 4 and the aerosol-generating material transfer component 6 are unitary or monolithic, and formed from a same material that is able to be used for both liquid transfer and heating, such as a material which is both porous and conductive. In still other cases, the aerosol-generating material transfer component 6 may operate other than by capillary action, such as by comprising an arrangement of one or more valves by which liquid may exit the reservoir 3 and be passed onto the heater 4.

A heater and wick (or similar) combination, referred to herein as an aerosol generator 5, may sometimes be termed an atomiser or atomiser assembly, and the reservoir with its source liquid plus the atomiser may be collectively referred to as an aerosol source. Various designs are possible, in which the parts may be differently arranged compared with the highly schematic representation of FIG. 1. For example, and as mentioned above, the wick 6 may be an entirely separate element from the heater 4, or the heater 4 may be configured to be porous and able to perform at least part of the wicking function directly (a metallic mesh, for example).

In the present example, the system is an electronic system, and the heater 4 may comprise one or more electrical heating elements that operate by ohmic/resistive (Joule) heating. The article 30 may comprise electrical contacts (not shown) at an interface of the article 30 which electrically engage to electrical contacts (no shown) at an interface of the aerosol provision device 20. Electrical energy can therefore be transferred to the heater 4 via the electrical contacts from the aerosol provision device 20 to cause heating of the heater 4. In other examples, the heater 4 may be inductively heated, in which case the heater comprises a susceptor in an induction heating arrangement which may comprise a suitable drive coil through which an alternating electrical current is passed. A heater of this type could be configured in line with the examples and embodiments described in more detail below.

In general, therefore, an aerosol generator in the present context can be considered as one or more elements that implement the functionality of an aerosol-generating element able to generate vapour by heating source liquid (or other aerosol-generating material) delivered to it, and a liquid (or other aerosol-generating material) transport or delivery element able to deliver or transport liquid from a reservoir or similar liquid store to the vapour-generating element by a wicking action/capillary force or otherwise. An aerosol generator is typically housed in an article 30 of an aerosol generating system, as in FIG. 1, but in some examples, at least the heater part may be housed in the device 20. Embodiments of the disclosure are applicable to all and any such configurations which are consistent with the examples and description herein.

Returning to FIG. 1, the article 30 also includes a mouthpiece or mouthpiece portion 35 having an opening or air outlet through which a user may inhale the aerosol generated by the heater 4.

The aerosol provision device 20 includes a power source such as a cell or battery 7 (referred to hereinafter as a battery, and which may or may not be re-chargeable) to provide electrical power for electrical components of the aerosol provision system 10, in particular to operate the heater 4. Additionally, there is control circuitry 8 (or sometimes referred to as controller 8) such as a printed circuit board and/or other electronics or circuitry for generally controlling the aerosol provision system 10. The control circuitry 8 may include a processor programmed with software, which may be modifiable by a user of the system. The control circuitry 8, in one aspect, operates the heater 4 using power from the battery 7 when vapour is required. At this time, the user inhales on the system 10 via the mouthpiece 35, and air A enters through one or more air inlets 9 in the wall of the device 20 (air inlets may alternatively or additionally be located in the article 30). When the heater 4 is operated, it vaporizes source liquid delivered from the reservoir 3 by the aerosol-generating material transfer component 6 to generate the aerosol by entrainment of the vapour into the air flowing through the system, and this is then inhaled by the user through the opening in the mouthpiece 35. The aerosol is carried from the aerosol generator 5 to the mouthpiece 35 along one or more air channels (not shown) that connect the air inlets 9 to the aerosol generator 5 to the air outlet when a user inhales on the mouthpiece 35.

More generally, the control circuitry 8 is suitably configured/programmed to control the operation of the aerosol provision system 10 to provide conventional operating functions of the aerosol provision system in line with established techniques for controlling such devices, as well as any specific functionality described as part of the foregoing disclosure. The control circuitry 8 may be considered to logically comprise various sub-units/circuitry elements associated with different aspects of the aerosol provision system's operation in accordance with the principles described herein and other conventional operating aspects of aerosol provision systems, such as display driving circuitry for systems that may include a user display (such as an screen or indicator) and user input detections via one or more user actuable controls/user input mechanisms 12. It will be appreciated that the functionality of the control circuitry 8 can be provided in various different ways, for example using one or more suitably programmed programmable computers and/or one or more suitably configured application-specific integrated circuits/circuitry/chips/chipsets configured to provide the desired functionality. The device 20 and the article 30 are separate connectable parts detachable from one another by separation in a direction parallel to the longitudinal axis, as indicated by the double-headed arrows in FIG. 1. The components 20, 30 are joined together when the system 10 is in use by cooperating engagement elements 21, 31 (for example, a screw or bayonet fitting) which provide mechanical and in some cases electrical connectivity between the device 20 and the article 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the article 30. An inductive work coil/drive coil can be housed in the device 20 and supplied with power from the battery 5, and the article 30 and the device 20 shaped so that when they are connected, there is an appropriate exposure of the heater 4 to flux generated by the coil for the purpose of generating current flow in the material of the heater. The FIG. 1 design is merely an example arrangement, and the various parts and features may be differently distributed between the device 20 and the article 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted, or be intended for multiple uses enabled by actions such as refilling the reservoir and recharging the battery. In other examples, the system 10 may be unitary, in that the parts of the device 20 and the article 30 are comprised in a single housing and cannot be separated. Embodiments and examples of the present disclosure are applicable to any of these configurations and other configurations of which the skilled person will be aware.

The present disclosure relates to the refilling of a storage area for aerosol-generating material in an aerosol provision system, whereby a user is enabled to conveniently provide a system with fresh aerosol-generating material when a previous stored quantity has been used up. It is proposed that this be done automatically, by provision of apparatus which is termed herein a refilling device, refilling unit, refilling station, or simply dock. The refilling device is configured to receive an aerosol provision system, or more conveniently, the article from an aerosol provision system having a storage area which is empty or only partly full, plus a larger reservoir holding aerosol generating material. A fluid communication flow path is established between the larger reservoir and the storage area, and a controller in the refilling device controls a transfer mechanism or arrangement operable to move aerosol-generating material along the flow path from the larger reservoir in the refilling device to the storage area. The transfer mechanism can be activated in response to user input of a refill request to the refilling device, or activation may be automatic in response to a particular state or condition of the refilling device detected by the controller. For example, if both an article and a larger reservoir are correctly positioned inside the refilling unit, refilling may be carried out. Once the storage area is replenished with a desired quantity of aerosol generating material (the storage area is filled or a user specified quantity of material has been transferred to the article, for example), the transfer mechanism is deactivated, and transfer ceases. Alternatively, the transfer mechanism may be configured to automatically dispense a fixed quantity of aerosol generating material in response to activation by the controller, such as fixed quantity matching the capacity of the storage area.

Figure 2:
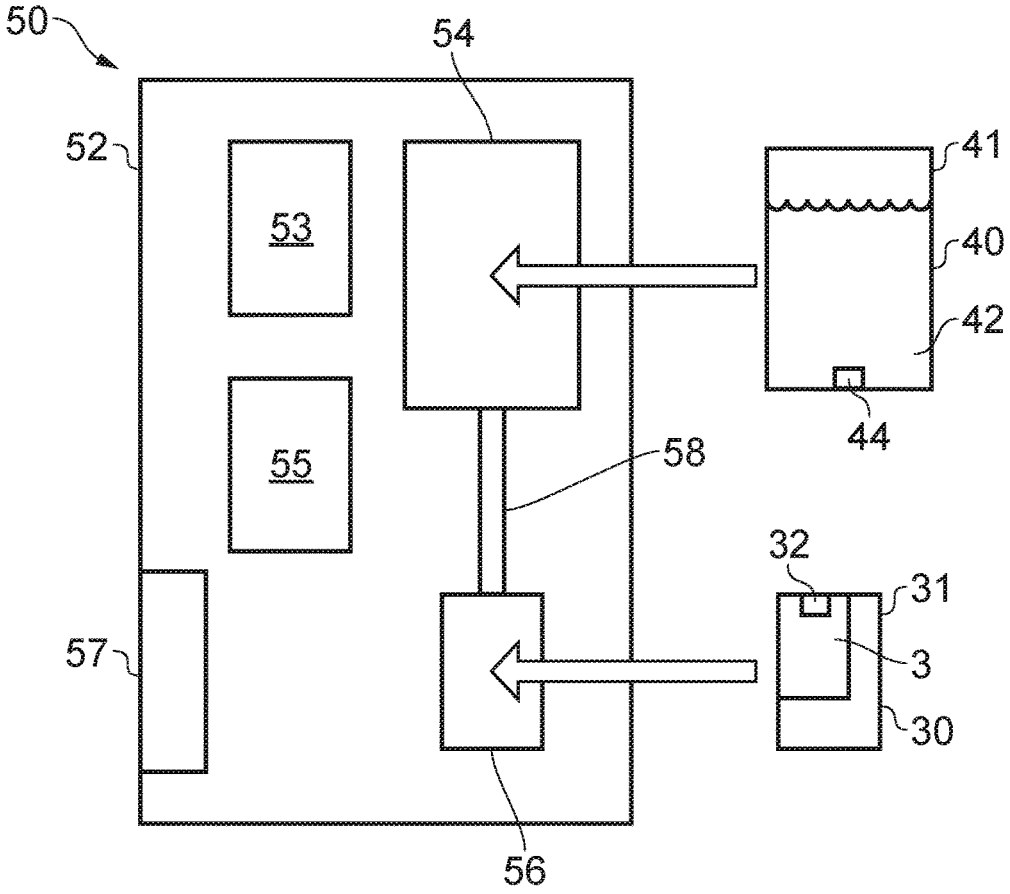
FIG. 2 shows a simplified schematic representation of a refilling device.

FIG. 2 shows a highly schematic representation of an example refilling device. The refilling device is shown in a simplified form only, to illustrate various elements and their relationship to one another. More particular features of one or more of the elements with which the present disclosure is concerned will be described in more detail below.

The refilling device 50 will be referred to hereinafter for convenience as a "dock". This term is applicable since a reservoir and an article are received or "docked" in the refilling device during use. The dock 50 comprises an outer housing 52. The dock 50 is expected to be useful for refilling of articles in the home or workplace (rather than being a portable device or a commercial device, although these options are not excluded). Therefore, the outer housing, made for example from metal, plastics or glass, may be designed to have a pleasing outward appearance such as to make it suitable for permanent and convenient access, such as on a shelf, desk, table or counter. It may be any size suitable for accommodating the various elements described herein, such as having dimensions between about 10 cm and 20 cm, although smaller or larger sizes may be preferred. Inside the housing 50 are defined two cavities or ports 54, 56. A first port 54 is shaped and dimensioned to receive and interface with a refill reservoir 40. The first or refill reservoir port 54 is configured to enable an interface between the refill reservoir 40 and the dock 50, so might alternatively be termed a refill reservoir interface. Primarily, the refill reservoir interface is for moving aerosol-generating material out of the refill reservoir 40, but in some cases the interface may enable additional functions, such as electrical contacts and sensing capabilities for communication between the refill reservoir 40 and the dock 50 and determining characteristics and features of the refill reservoir 40.

The refill reservoir 40 comprises a wall or housing 41 that defines a storage space for holding aerosol-generating material 42. The volume of the storage space is large enough to accommodate many or several times the storage area/reservoir 3 of an article 30 intended to be refilled in the dock 50. A user can therefore purchase a filled reservoir 40 of their preferred aerosol generating material (flavor, strength, brand, etc.), and use it to refill an article 30 multiple times. A user could acquire several reservoirs 40 of different aerosol generating materials, so as to have a convenient choice available when refilling an article. The refill reservoir 40 includes an outlet orifice or opening 44 by which the aerosol generating material 42 can pass out of the refill reservoir 40.

A second port 56 defined inside the housing is shaped and dimensioned to receive and interface with an article 30. The second or article port 56 is configured to enable an interface between the article 30 and the dock 50, so might alternatively be termed an article interface. Primarily, the article interface is for receiving aerosol-generating material into the article 30, but in some cases the interface may enable additional functions, such as electrical contacts and sensing capabilities for communication between the article 30 and the dock 50 and determining characteristics and features of the reservoir 30.

The article 30 itself comprises a wall or housing 31 that has within it (but possibly not occupying all the space within the wall 31) a storage area/reservoir 3 for holding aerosol-generating material. The volume of the storage area 3 is many or several times smaller than the volume of the refill reservoir 40, so that the article 30 can be refilled multiple times from a single refill reservoir 40. The article 30 also includes an inlet orifice or opening 32 by which aerosol-generating material can enter the storage area 3. Various other elements may be included with the article 30, as discussed above with regard to FIG. 1.

The housing also accommodates a fluid conduit 58, being a passage or flow path by which the reservoir 40 and the storage area 3 of the article 30 are placed in fluid communication, so that aerosol-generating material can move from the refill reservoir 40 to the article 30 when both the refill reservoir 40 and the article 30 are correctly positioned in the dock 50. Placement of the refill reservoir 40 and the article 30 into the dock 50 locates and engages them such that the fluid conduit 58 is connected between the outlet orifice 44 of the reservoir 40 and the inlet orifice 32 of the article 30. Note that in some examples, all or part of the fluid conduit 58 may be formed by parts of the refill reservoir 40 and the article 30, so that the fluid conduit is created and defined only when the refill reservoir 40 and/or the article 30 are placed in the dock 50. In other cases, the fluid conduit 58 may be a flow path defined within the housing 52 of the dock 50, to each end of which the respective orifices are engaged.

Access to the reservoir port 54 and the article port 56 can be by any convenient means. Apertures may be provided in the housing 52 of the dock 50, through which the refill reservoir 40 and the article 30 can be placed or pushed. The refill reservoir 40 and/or the article 30 may be completely contained within the respective apertures or may partially be contained such that a portion of the refill reservoir 40 and/or the article 30 protrude from the respective ports 54, 56. In some instances, doors or the like may be included to cover the apertures to prevent dust or other contaminants from entering the apertures. When the refill reservoir 40 and/or the article 30 are completely contained in the ports 54, 65, the doors or the like might require to be placed in closed state to allow refilling to take place. Doors, hatches and other hinged coverings, or sliding access elements such as drawers or trays, might include shaped tracks, slots or recesses to receive and hold the refill reservoir 40 or the article 30, which bring the refill reservoir 40 or the article 30 into proper alignment inside the housing 52 when the door, etc. is closed. These and other alternatives will be apparent to the skilled person, and do not affect the scope of the present disclosure.

The dock 50 also includes an aerosol generating material transfer mechanism, arrangement, or apparatus 53, operable to move or cause the movement of fluid out of the refill reservoir 40, along the conduit 58 and into the article 30. Various options are contemplated for the transfer mechanism 53, but purely by way of an example, the transfer mechanism 53 may comprise a fluid pump, such as a peristaltic pump. However, in other implementations, the transfer mechanism may comprise a moveable piston or the like. Various suitable approaches for transferring the aerosol-generating material from the refill reservoir 40 to the article 30 may be implemented in accordance with the present disclosure.

A controller 55 is also included in the dock 50, which is operable to control components of the dock 50, in particular to generate and send control signals to operate the transfer mechanism 53. As noted, this may be in response to a user input, such as actuation of a button or switch (not shown) on the housing 52, or automatically in response to both the refill reservoir 40 and the article 30 being detected as present inside their respective ports 54, 56. The controller 55 may therefore be in communication with contacts and/or sensors (not shown) at the ports 54, 56 in order to obtain data from the ports and/or the refill reservoir 40 and article 30 that can be used in the generation of control signals for operating the transfer mechanism 3. The controller 55 may comprise a microcontroller, a microprocessor, or any configuration of circuitry, hardware, firmware or software as preferred; various options will be apparent to the skilled person.

Finally, the dock 50 includes a power source 57 to provide electrical power for the controller 53, and any other electrical components that may be included in the dock, such as sensors, user inputs such as switches, buttons or touch panels, and, if present, display elements such as light emitting diodes and/or display screens to convey information about the dock's operation and status to the user. In addition, the transfer mechanism may be electrically powered. Since the dock 50 may be for permanent location in a house or office, the power source 57 may comprise a socket for connection of an electrical mains cable to the dock 50, so that the dock 50 may be "plugged in" to mains electricity. Any suitable electrical converter to convert mains electricity to a suitable operational supply of electricity to the dock 50 may be provided, either on the mains cable or within the dock 50. Alternatively, the power source 57 may comprise one or more batteries, which might be replaceable or rechargeable, and in the latter case the dock 50 may also comprise a socket connection for a charging cable adapted to recharge the battery or batteries while housed in the dock.

Further details relating to the fluid conduit will now be described.

Figure 3:
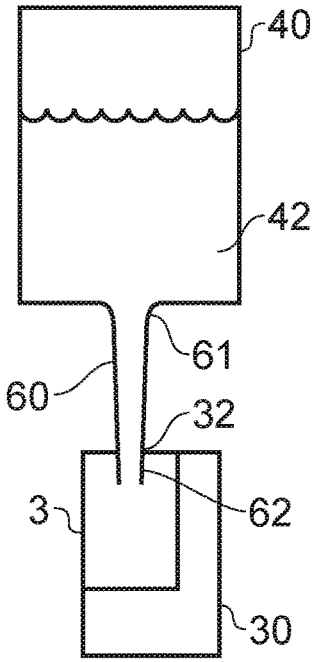
FIG. 3 shows a simplified cross-sectional view of a reservoir refilling an article of an aerosol provision system via a nozzle according to an example of the disclosure.

FIG. 3 shows a schematic representation of the fluid coupling between the refill reservoir 40 and article 30 using a nozzle 60 arranged for use as a fluid conduit 58. Other components of the dock 50 are omitted from FIG. 3 for clarity. In this implementation, the nozzle 60 may form part of the dock 50. A refill reservoir 40 containing a source liquid 42 is arranged to couple to the nozzle 60 at an outlet orifice of the refill reservoir 40, such that a first end or proximal end 61 of the nozzle 60 is arranged adjacent and in fluid communication with the refill reservoir 40. The way in which the proximal end 61 of the nozzle 60 couples to the refill reservoir 40 is not significant to the principles of the present disclosure, and any suitable mechanism may be employed. For example, the proximal end 61 of the nozzle 60 may be arranged in the refill reservoir port 54 of the dock 50 and provided such that engaging the refill reservoir 40 with the reservoir port 54 additionally engages the outlet orifice of the refill reservoir 40 with the proximal end 61 of the nozzle 60 in a fluid tight manner (e.g., via friction fit). Additionally, fluid may be retained in the refill reservoir 40 by, for example a valve or septum at the outlet orifice of the refill reservoir 40. The valve or septum may be opened/pierced prior to fluid transfer to the article 30 commences, which may occur upon insertion of the refill reservoir 40 into the reservoir port 54 or at some time thereafter. In other cases, surface tension may be sufficient to retain the fluid, for example if the bore of the nozzle 60 and/or outlet orifice is sufficiently small. The nozzle 60 has a tubular elongate shape, and extends from the first end 61 to a second or distal end 62, remote from the refill reservoir 40, which acts as the fluid dispensing point. The distal end 62 is inserted into or otherwise engages with the inlet orifice 32 of the article 30, and in this example extends directly into the storage area 3 of the article 30. In other examples, there may be tubing, pipework or some other fluid flow path connecting the inlet orifice 32 to the interior of the storage area 3. Similarly, fluid may be retained in the storage area 3 of the article 30 by, for example a valve or septum at the inlet orifice of the article 30. The valve or septum may be opened/pierced prior to fluid transfer to the article 30 commences, which may occur upon insertion of the article 30 into the article port 56 or at sometime thereafter. In other cases, surface tension may be sufficient to retain the fluid, for example if the bore of the nozzle 60 is sufficiently small.

In use, source liquid 42 is moved out of the refill reservoir 40 using the fluid transfer mechanism 53 of the dock 50, along a fluid channel defined by the nozzle 60 (acting as the fluid conduit) from the proximal end 61 to the distal end 62, where it reaches a fluid outlet of the nozzle and flows into the storage area 3, in order to refill the article 30 with liquid aerosol-generating material.

The above arrangement of FIG. 3 depicts one example of how the fluid conduit 58 may be realised and other arrangements of the fluid conduit 58 may be possible in accordance with the principles of the present disclosure. For example, the nozzle may be embodied as an integral part of the refill reservoir 40, to provide the outlet orifice. This associates the nozzle only with the particular reservoir and its contents, thereby avoiding any cross-contamination that may arise from using reservoirs of different aerosol-generating material with the same nozzle. The nozzle is engaged into the inlet orifice of the article 30 in order to enable fluid transfer from the reservoir into the article. The engagement may be achieved by movement of the article towards the refill reservoir, or vice versa, for example, when both have been installed in the dock. It should be appreciated from the above that the dock 50 is configured to supply source liquid 42 from the refill reservoir 40 to the reservoir 3 of the article 30. A user may decide to refill the reservoir 3 of the article 30 when the reservoir 3 is depleted (i.e., when the source liquid therein has been used up), or the user may decide to refill the reservoir 3 when it is partially full (e.g., the user may be away from the dock 50 for a prolonged period of time and wants to ensure they do not run out of source liquid in reservoir 3 before they can return to the dock 50). In any case, it is the dock 50 that is capable of refilling the reservoir 3 of the article 30.

However, in some instances, the system may be subject to abuse and, in particular, the article 30 may be manually refilled with aerosol-generating material (that is, a user may tamper with the article 30 and be able to refill the storage area of the article 30 with aerosol-generating material in a manner that does not make use of the dock 50). Not only does this potentially lead to spillage of the aerosol-generating material during the manual refilling process, but this may lead also to instances where user is able to fill the storage area 3 of the article 30 with unauthorised aerosol-generating material, for example counterfeit aerosol-generating material which may or may not comply with appropriate health and safety or food and drug regulations. This may lead to damage/harm being caused to either the user of the article and/or to the article 30/heater 4 of the article 30 itself depending on the properties of the aerosol-generating material used. Additionally, manually refilling the article 30 may mean that instances of under- or over-filling the reservoir 3 are more likely to occur, which may in turn lead to damage/harm to the components of the article 30 (particularly if the aerosol provision device has no means of directly detecting the amount of aerosol generating material in the article 30 or if the detection of the amount of aerosol generating material is inaccurate due to unexpected variations in the properties of the aerosol-generating material (e.g., liquids with different properties which may affect the detection mechanism)).

Hence, in summary, preventing the use of articles which have been manually refilled with (unauthorised) aerosol-generating material can help avoid harm/damage to the user and/or components of the aerosol provision system.

Figure 4:
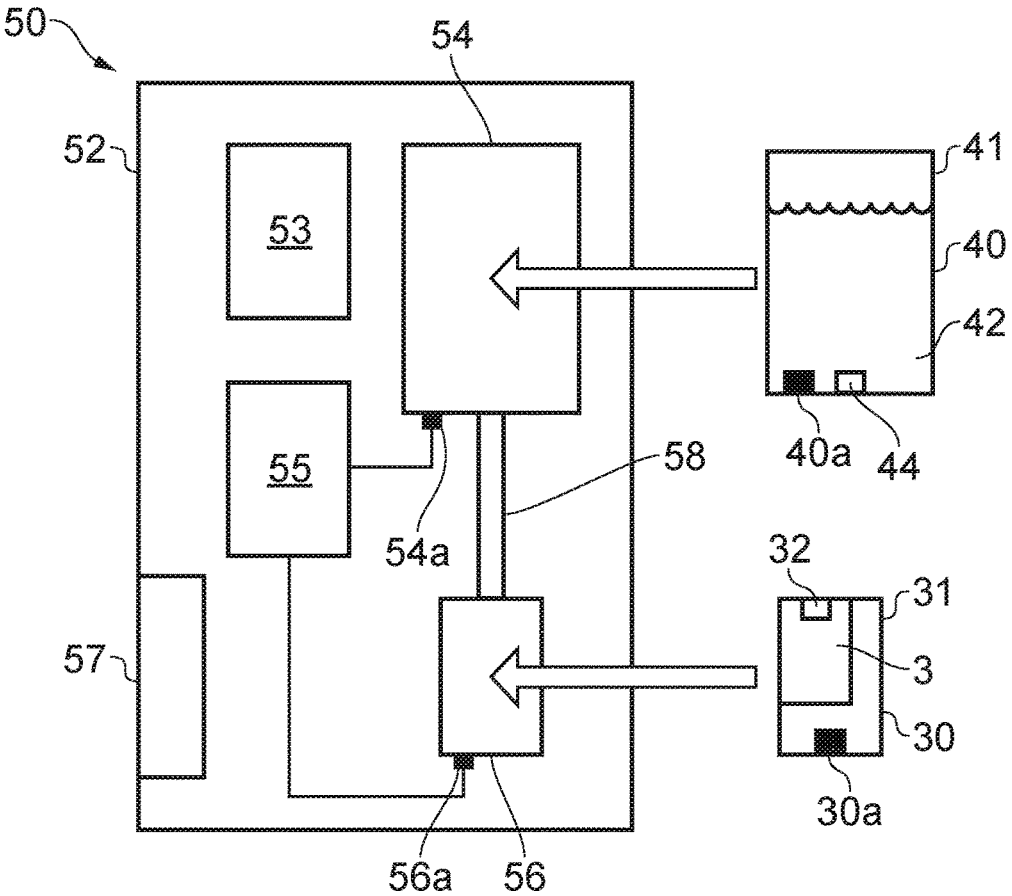
FIG. 4 shows a simplified schematic representation of a refilling device in which embodiments of the present disclosure can be implemented, wherein the refilling device incudes a reader for reading a readable element of an article.

FIG. 4 is a highly schematic representation of a refilling device/dock 50 configured to help prevent the use of articles 30 that have been manually refilled (and thus could contained unauthorised aerosol-generating material). FIG. 4 is based on, and will be understood from, FIG. 2. Like components are shown with the same reference numerals as used in FIG. 2 and a detailed description thereof is omitted; instead the reader is referred to the description provided in relation to FIG. 2 for these components. Only the differences with respect to FIG. 2 are explained herein.

FIG. 4 schematically depicts an implementation where the article 30 and, optionally, refill reservoir 40 are provided with respective readable elements 30*a*, 40*a*. The readable elements 30*a*, 40 will be described in more detail below, but may take the form of or include, for example, an electronically readable memory (such as a microchip or the like) that contain information in the form of a digital/binary code which can be electronically read from the memory. The electronically readable memory may be any suitable form of memory, such as electronically erasable programmable read only memory (EEPROM), although other types of suitable memory may be used depending on the application at hand. The electronically readable memory in this implementation is non-volatile, as the article 30 and refill reservoir 40 are both separable from a power source (e.g., power source 7 located in the aerosol provision device 20 or power source 53 located in the dock 50) and do not contain their own power source. For example, the article 30 and refill reservoir 40 may be packaged and sold individually from the aerosol provision device 20 and dock 50 and thus not be in connection with a power source while packaged ready for sale. However, in other implementations, the electronically readable memory may be volatile or semi-volatile, in which case the article 30/refill reservoir 40 may require their own power sources.

The readable element 30*a* of the article 30 may be any suitable readable element 30*a* which is at least capable of being read by an associated reader 56*a* provided in the dock 50. Equally, the readable element 40*a* of the refill reservoir 40 may be any suitable readable element 40*a* which is at least capable of being read by an associated reader 54*a* provided in the dock 50. The readable elements 30*a*, 40*a* may be electronically read by coupling electrical contacts (not shown) on the article 30 or refill reservoir 40 with electrical contacts (not shown) in the article port 56 or refill reservoir port 54, respectively. That is, when the article 30 and refill reservoir 40 are positioned in the respective ports 56, 54, an electrical connection is formed between the article 30 and the reader 56*a* in the article port 56 and an electrical connection is formed between the refill reservoir 40 and the reader 54*a* in the refill port 54. Application of an electric current from the reader 56*a*, 54*a* to the readable elements 30*a*, 40*a* allows the reader 56*a*, 54*a* to obtain information pertaining to the article 30 or refill reservoir 40 respectively. Alternatively, the readable elements 30*a*, 40*a* may be electronically read using any suitable wireless technology, such as RFID or NFC, and the article 30/refill reservoir 40 may be provided with suitable hardware (e.g., an antenna) to enable such reading by a suitable wireless reader 56*a*, 54*a*.

As seen in FIG. 4*a*, the respective readers 54*a*, 56*a* are coupled to the controller 55 and are therefore configured to provide the obtained information from the article 30 and/or refill reservoir 40 to the controller 55 of the dock 50.

The readable element 40*a* provided as part of the refill reservoir 40 is, as mentioned, optional. However, when provided, the readable element 40*a* may contain information associated with the aerosol-generating material held within the refill reservoir 40. In some implementations, this information may be indicative of the authenticity of the refill reservoir 40 and the aerosol-generating material stored therein. For instance, the readable element 40*a* may contain a code or the like which signifies the refill reservoir 40 originates from a particular manufacture, and if said manufacture is approved for use with the dock 50, then the controller 55 may permit refilling of an article 30 from refill reservoir 40. In some instances, the dock 50 may be configured to operate only with refill reservoirs 40 from a single manufacturer. Including such a code which can signify whether the refill reservoir 40 is authorised can help ensure that only authorised aerosol-generating material is used to refill the article 30.

The readable element 40*a* may also include other information. For instance, the information may include the type of aerosol-generating material (e.g., a liquid, solid, etc.) and/or information about the constituents of the aerosol-generating material, e.g., the presence, type/names or concentration of any flavorings, active ingredients, aerosol formers, etc. This information may be communicated in the form of a name or code associated with given combinations of types and constituents. For example, code 001 may correspond to a nicotine containing source liquid, while 002 may correspond to a nicotine free source liquid. This information may be used either to inform the user of the aerosol-generating material installed in the dock 50 (e.g., on a display screen or user interface of the dock 50), or may be used to make a determination as to whether refilling using the aerosol generating material of the refill reservoir 40 is permitted. Other information, such as a batch code, sell by or use by date, etc. may also be stored on the readable element 40*a* and communicated to the controller 55 which also could be used to make a determination as to whether refilling using the aerosol generating material of the refill reservoir 40 is permitted.

It should be appreciated that while the readable element 40*a* is described as an electronic readable element comprising a memory or the like, in other implementations the readable element 40*a* may take different forms and any element that is able to contain information in a format which can be obtained/read by a suitable reader can be employed in accordance with the present disclosure. For example, the readable element 40*a* may comprise an optically readable element and the reader 54*a* may comprise a suitable optical reader (such as a camera), or in another example the readable element 40*a* may comprise a magnetically readable element (such as magnetic tags or strips) and the reader 54*a* may comprise a suitable magnetic reader (such as a magnetic reading head).

Alternatively, some or all of the above information may be communicated in other ways to the controller 55 not using a readable element 40*a*. For example, the shape of the housing of the refill reservoir 40 may communicate whether the refill reservoir is authorised (e.g., the housing may have a specific shape).

Turning to the article 30, the article comprises a readable element 30*a*. In accordance with aspects of the present disclosure, the readable element 30*a* of the article 30 is capable of storing and updating an indication of the usage of the article 30 for generating aerosol from the aerosol-generating material stored in the reservoir 3. In some implementations, the readable element 30*a* is or includes a readwrite memory element capable of being read by a suitable reader (such as reader 56*a*) and written to by a suitable writer (not shown). In some implementations, the readable element 30*a* is configured to store a counter value which is incremented or decrement upon use of the article 30 to generate aerosol (e.g., each time the aerosol generator 4 is activated). The counter value may be arranged to count down to zero or up from zero depending on the specific implementation at hand (discussed in more detail below). The readable element 30*a* may therefore comprise any suitable element which is able to both contain and update information stored within the readable element.

The readable element 30*a* may be configured to solely store information associated with the usage of the article 30 and therefore comprise a relatively simplistic and inexpensive memory element or the like. In other implementations, the readable element 30*a* may be arranged to store additional information associated with the article or the aerosol-generating material stored therein (for example, such information about the type/constitution of the aerosol-generating material may be communicated from the readable element 40*a* of the refill reservoir 40). The additional information may be communicated to the controller 55 of the dock 50 as appropriate.

Figure 5:
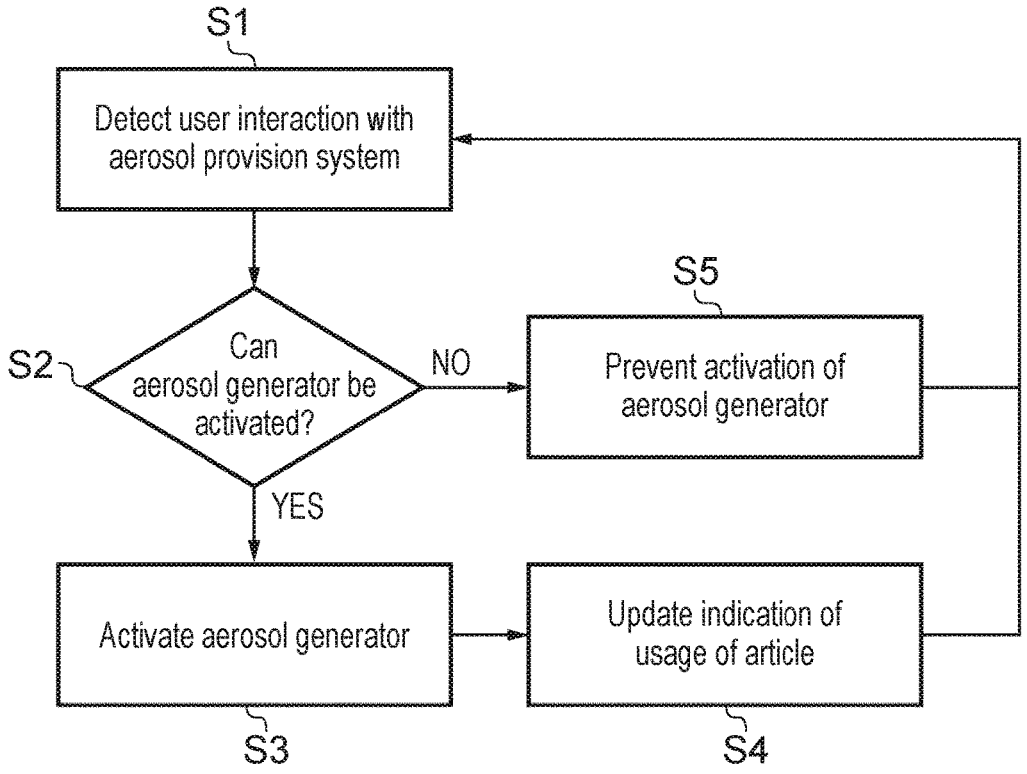
FIG. 5 shows flow diagram of method steps for determining whether to activate an aerosol generator or not on the basis of an indication of usage of the article.

FIG. 5 describes a method for using the article 30 including the readable element 30*a* for the purposes of generating aerosol in accordance with aspects of the present disclosure. The method assumes that the article 30 is provided with a quantity of aerosol generating material in the storage area 3 thereof, and also that the article 30 is coupled to the aerosol provision device 20, such that the aerosol provision system (i.e., the article 30 and aerosol provision device 20 combined) is in a state suitable for generating aerosol from the aerosol generating material.

The method starts at step S1. At step S1 the user interacts with the aerosol provision system in a manner suitable for generating aerosol. The way in which the user interacts with the aerosol provision system in a manner suitable for generating aerosol is not particularly significant to the principles of the present disclosure. However, by way of example, the aerosol provision system may be provided with a button or the like which the user presses in order to supply electrical power to the aerosol generator 4 to cause the aerosol generator to generate aerosol from the aerosol-generating material. Alternatively, or additionally, the aerosol provision system may include a sensor configured to sense when a user inhales on the aerosol provision system (e.g., at mouthpiece 35) and subsequently supply electrical power to the aerosol generator to generate aerosol from the aerosol-generating material.

Assuming an interaction is detected, the method proceeds to step S2. At step S2, the method determines whether the aerosol generator can be activated. This step may be implemented in different ways depending on the technology used by the aerosol provision system to store an indication of the usage of the article 30 of the aerosol provision system.

In some implementations, the aerosol provision device 20 is configured to read the indication of the usage of the article 30 from the readable element 30*a*. For instance, the aerosol provision device may be provided with electrical contacts that allow for electrical coupling to the readable element 30*a*, or alternatively, a suitable wireless reader may be provided in the aerosol provision device capable of wirelessly reading the readable element 30*a*. In some implementations, the readable element 30*a* is coupled to electrical contacts in the article 30 that are provided to supply power to the aerosol generator 4, and accordingly, the aerosol provision device 20 is capable of communicating with the readable element 30*a* using the electrical contacts that provide power to the aerosol generator 4, thus reducing the number of electrical contacts required on the article 30 and/or aerosol provision device 20. When the aerosol provision device 20 reads the indication of usage from the article 30, the aerosol provision device 20 (or more particularly control circuitry 8) is configured to determine whether the received indication of usage permits further usage of the article 30.

As mentioned previously, the indication of usage may be a counter value. The counter value may be arranged to start at a high number (corresponding to a storage area 3 of the article 30 that is full of aerosol-generating material) and count down to zero (corresponding to an empty/depleted storage area 3 or a storage area 3 that is approaching an empty/depleted state if it is desired to have some tolerance before the article 30 is completely empty of aerosol-generating material). In this instance, if the control circuitry 8 receives a count value of zero from the readable element 30*a* of the article 30, the control circuitry 8 may prevent activation of the aerosol generator 4 (this corresponds to a NO at step S2). Otherwise, if the control circuitry 8 receives a value greater than zero, the control circuitry 8 may allow the aerosol generator 4 to be activated (and thus generate aerosol) in response to the corresponding user input (this corresponds to a YES at step S2). Alternatively, the counter value may be arranged to start at zero (corresponding to a storage area 3 of the article 30 that is full of aerosol-generating material) and count up to a high number (corresponding to an empty/depleted storage area 3 or a storage area 3 that is approaching an empty/depleted state if it is desired to have some tolerance before the article 30 is completely empty of aerosol-generating material). In this instance, the control circuitry 8 is configured to compare the received count value from the readable element 30*a* of the article 30 to a predetermined threshold which may be stored in the control circuitry 8. The control circuitry 8 may prevent activation of the aerosol generator 4 is the count value is equal to or exceeds the predetermined threshold (this corresponds to a NO at step S2). Otherwise, if the received count value is less than the predetermined threshold, the control circuitry 8 may allow the aerosol generator 4 to be activated (and thus generate aerosol) in response to the corresponding user input (this corresponds to a YES at step S2).

In other implementations, the article 30 may be configured to determine whether the aerosol generator 4 can be activated. For instance, the article 30 may include control circuitry, which may form a part of the readable element 30*a* or be separate from and coupled to the readable element 30*a*. In this implementation, the control circuitry of the article 30 is configured to obtain the indication of the usage of the article 30 from the readable element 30*a* in response to a determination that there has been a user input detected at step S1. For example, if a user input is detected at step S1, the control circuitry 8 of the aerosol provision device may supply power to the article 30 (coupled to the aerosol provision device) and the control circuitry of the article 30 may be configured to detect the provision of this power to the article 30, and in response, determine whether the indication of the usage of the article 30 from the readable element 30*a* permits the aerosol generator 4 to be activated.

As above, the indication of the usage of the article 30 may be a counter value, and the counter value may be arranged to start at a high number and count down to zero or the counter value may be arranged to start at zero and count up to a high number, as described above. In these instances, the control circuitry of the article 30 is configured to make a determination based on the obtained counter value whether the aerosol generator 4 may be activated or not in a similar manner to as described above (except it is the control circuitry of the article 30 not the control circuitry 8 of the aerosol provision device that makes the determination).

Figure 6:
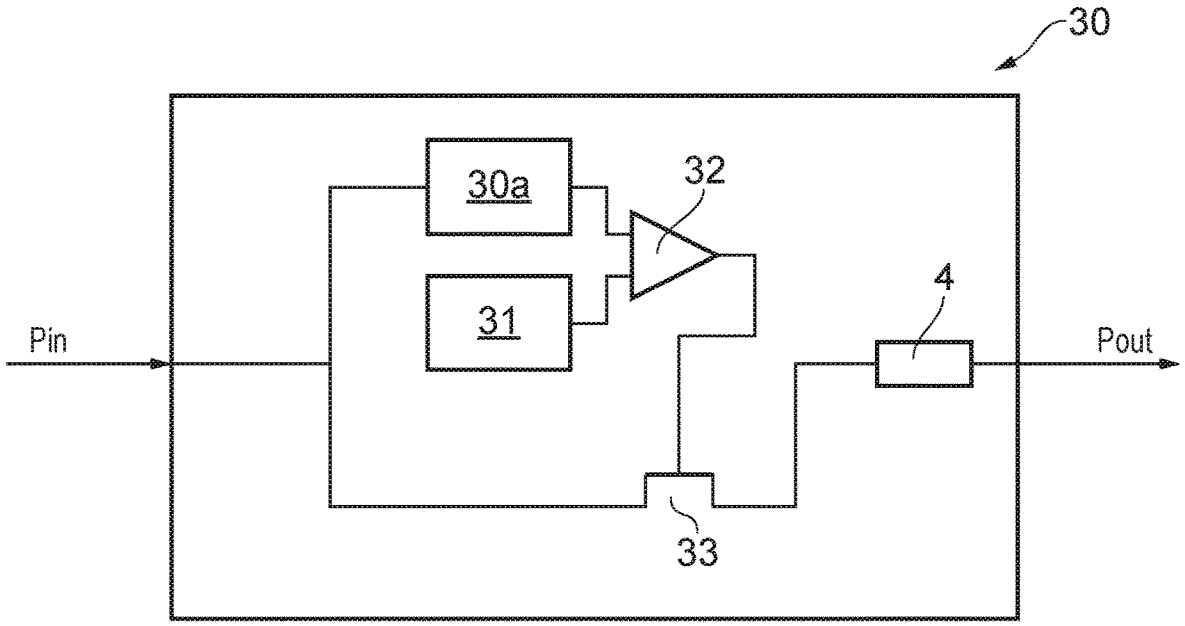
FIG. 6 shows a schematic representation of an article including control circuitry for determining whether to activate the aerosol generator of the article.

It should be appreciated that the control circuitry of the article 30 may be relatively inexpensive/non-complex in order to reduce manufacturing costs associated with the article 30. FIG. 6 schematically shows an example of the article 3 comprising control circuitry.

In the implementation shown in FIG. 6, the article 30 comprises an aerosol generator 4 (such as a resistive heating element) which is configured to be supplied with power to aerosolize aerosol-generating material located within the article 30 (not shown in FIG. 6 for clarity). The article 30 comprises electrical contacts which connect with corresponding electrical contacts on the aerosol provision device 20, in order to allow power from the power source 7 to be supplied to the aerosol generator 4. The provision of power to/from the article 30 is represented schematically with the arrowed lines, Pin and Pout, respectively.

The article 30 further comprises the readable element 30*a* (which in the shown implementation is a counter for storing and updating a counter value indicative of usage of the article 30), a threshold value storage element 31 for storing a threshold value suitable for indicating the article 30 is depleted or close to depletion of aerosol-generating material, a comparator 32, and a switch 33.

As can be seen from FIG. 6, when power is supplied to the article 30 from the aerosol provision device (i.e. in response to a user input signifying the user's desire to generate aerosol from the aerosol-generating material), both the readable element 30*a* and the switch 33 receive power. The readable element 30*a* sends either actively or passively the indication of usage of the article 30 to the comparator 32, for example to a first input of the comparator 32. The threshold value stored in the threshold value storage element 31 is also sent to the comparator 32, for example to a second input on the comparator 32. In this instance, both the threshold value and the indication of usage of the article are numerical values and the comparator 32 is subsequently configured to compare the two values and output a signal depending on the comparison. In particular, when the result of the comparison indicates that the aerosol generator 4 is permitted to generate aerosol (e.g., the value indicative of usage is either lower than the non-zero threshold value or greater than a zero threshold value), the comparator 32 outputs a signal to the switch 33 which causes the switch 33 to close (or if the switch 33 is biased closed, no signal may be output by the comparator 32). When the switch 33 is closed, power is permitted to flow through the switch 33 to the aerosol generator 4. Conversely, when the result of the comparison indicates that the aerosol generator 4 is not permitted to generate aerosol (e.g., the value indicative of usage is either greater than the non-zero threshold value or equal to a zero threshold value), the comparator 32 outputs a signal to the switch 33 which causes the switch 33 to open (or if the switch 33 is biased open, no signal may be output by the comparator 32). When the switch 33 is open, no power is able to flow through the switch 33 to the aerosol generator 4, and subsequently aerosol generation is prevented.

FIG. 6 above shows an example arrangement for the control circuitry that may be implemented on the article 30. However, it should be appreciated that other circuitry or other arrangements may be possible which achieve the same or similar effects. Equally, other arrangements may be provided such as an article 30 including a microprocessor arranged to perform the comparison and control power supply to the aerosol generator 4.

It should further be appreciated that, regardless of whether it is the article 30 or the control circuitry 8 of the aerosol provision device that determines whether the aerosol generator 4 can be activated, storing an indication of usage on the article 30 (i.e., in the readable element 30*a*) helps facilitate the accurate reading (and recording) of usage of the article 30 when switching between devices. That is to say, the indication of usage is stored locally on the article 30 such that whatever device the article 30 is coupled to an accurate reading of usage can be provided.

With reference back to FIG. 5, once it has been determined that the aerosol generator may be activated (i.e., a YES at step S2), the method proceeds to step S3 where the aerosol generator 4 is activated and subsequently generates aerosol from the aerosol-generating material.

At the same time or after the aerosol generator 4 has been activated, at step S4 the method is configured to update the indication of usage of the article 30 to effectively record that the article 30 has been used to generate aerosol as per step S3. The way in which the indication of usage is updated may depend on the form in which the usage is recorded. For example, in some implementations, the aerosol provision device 20 is configured to update the indication of usage of the article 30 stored in the readable element 30*a*. In these implementations, the aerosol provision device 20 is provided with the capability to communicate to/with the readable element 30*a* and update the indication of usage of the article 30 stored within the readable element 30*a*. For instance, this may include replacing the stored indication of usage with a new indication of usage that takes account of the activation of the aerosol generator 4 at step S3. In other implementations, the article 30 (via the control circuitry of the article 30) is configured to update the indication of usage of the article 30 stored in the readable element 30*a* itself. For example, the article 30 may include suitable circuitry which is configured to replace the stored indication of usage with a new indication of usage that takes account of the activation of the aerosol generator 4 at step S3.

In implementations where the indication of usage is a counter value, the counter value may be incremented (or decremented) by one. Hence, the previous counter value stored in the readable element 30*a* is updated/replaced by the new counter value which differs from the previous counter value by one. That is to say, in these embodiments, each activation of the aerosol generator constitutes a use of the article 30 for generating aerosol from the aerosol generating material, and the indication of usage of the article 30 records the number of activations of the aerosol generator (or the number of activations remaining).

According to FIG. 5, when the indication of usage of the article has been updated at step S4, the method proceeds back to step S1 and awaits the next detection of a user's interaction with the aerosol provision system.

For completeness, if it is determined at step S2 that the aerosol generator 4 cannot be activated (i.e. a NO at step S2), the method proceeds to step S5 and the aerosol generator 4 is not activated despite the detection of the user's interaction with the aerosol provision system. In some implementations, the aerosol provision system may comprise a feedback element, such as an LED or similar, which is able to indicate to the user that the aerosol generator is not permitted to activate.

It should be appreciated that although step S4 is shown as preceding step S3, steps S4 and S3 may occur in parallel. Additionally, it should also be appreciated that step S3 may occur in parallel with, or shortly after, step S2. That is, once an indication of the user's desire to generate aerosol at step S1 has been received, the method may include updating the previous indication of usage of the article 30 to include the current/expected usage, while the step S2 proceeds on the basis of the previous indication of the usage.

Additionally, FIG. 5 shows the indication of usage being update in response to the aerosol generator being activated. However, it should be appreciated that the indication of usage of the article 30 may be updated regardless of whether or not the aerosol generator is actually activated in response to a detected user interaction with the aerosol provision system. For example, if the current counter value is greater than a non-zero threshold counter value, then step S2 dictates that the method proceeds to step S5 and the aerosol generator 4 is prevented from activating. However, the counter value may still be incremented by one in this instance. Equally, if the current counter value is equal to or less than a zero value threshold, in some implementations the counter value may be decremented by one to a lower number (e.g., minus 1, minus 2, etc.). In other implementations, if the counter value reaches zero, then the circuitry may simply replace the currently stored value of zero with a new value of zero (in other words, this is a redundant replacement).

As mention above, the article 30 of the present disclosure is designed to be refillable; that is, the article 30 may be refilled with aerosol-generating material. More particularly, the article 30 is designed to be refilled using the dock 50. However, the present disclosure also considers instances where the article 30 may have been refilled manually (or more generally without use of the dock 50 or a similar dock 50). As previously stated, manual refilling of the article 30 may enable the storage area 3 of the article 30 to be filled with unauthorised aerosol-generating material, for example counterfeit aerosol-generating material which may or may not comply with appropriate health and safety or food and drug regulations. The use of the readable element 30*a*, in combination with suitable control algorithms and mechanism on the dock 50, may help to prevent the use of articles 30 for further (future) generation of aerosol which may have been refilled manually and thus potentially contaminated with unauthorised aerosol-generating material.

Figure 7:
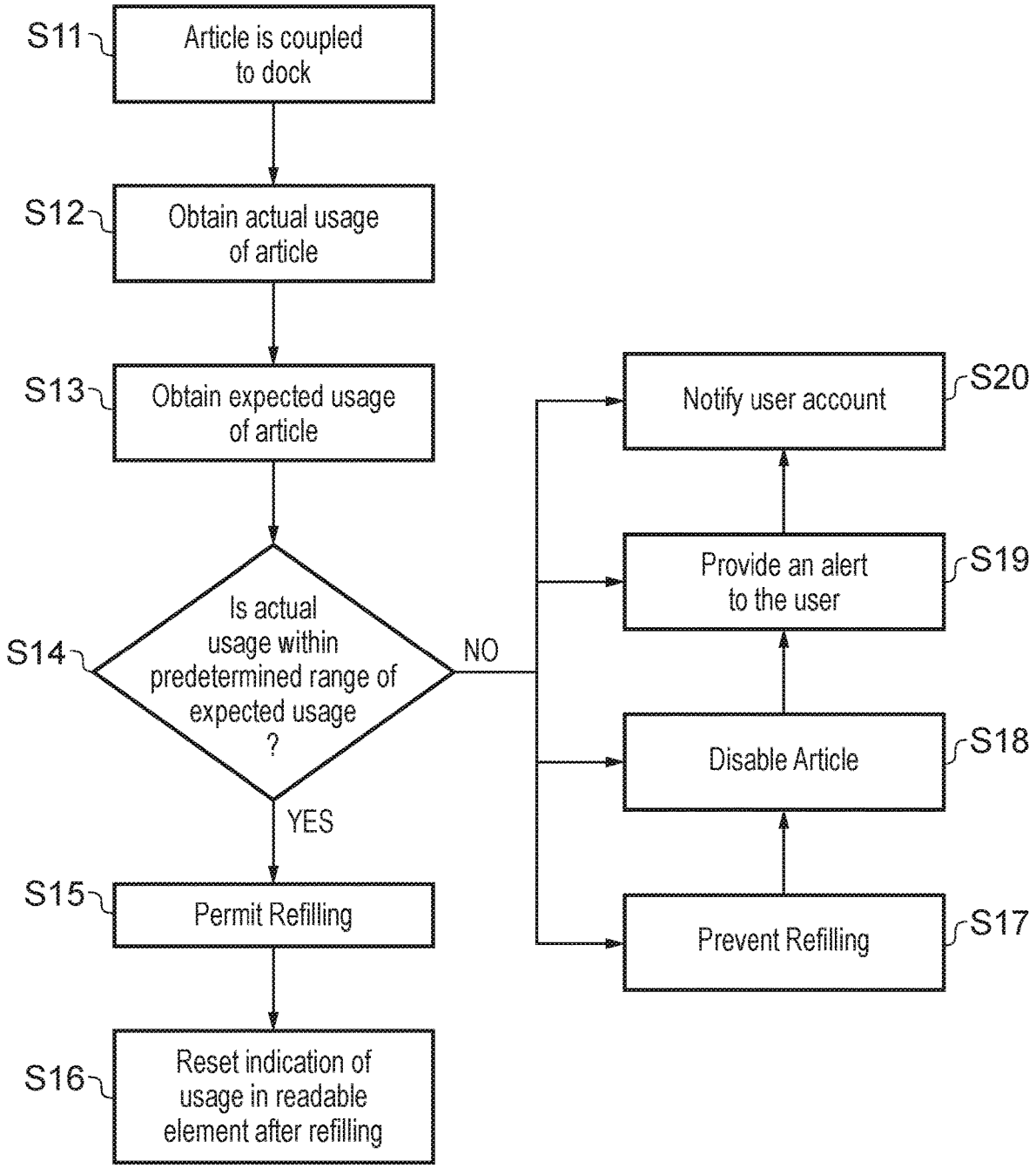
FIG. 7 shows a flow diagram of method steps for determining whether to permit or prevent refilling of an article using a refilling unit according to aspects of the present disclosure.

By way of introduction to FIG. 7, which describes an example method according to principles of the present disclosure, we first consider the readable element 30*a* and article 30 in the situation where the article 30 is refilled manually.

Let us assume, for the purposes of an example, that the indicator of usage of the article 30 is a counter value that counts from low to high in response to activations of the aerosol generator 4 (i.e., a higher number represents more activations of the aerosol generator 4). When considering a full article 30 (i.e., an article which is full of aerosol-generating material, either as manufactured or as (re) filled by a dock 50), the corresponding threshold value is set at a suitably high number. The threshold value may be set in proportion to the average number of activations that one might expect from the given quantity of aerosol-generating material that fills the storage area 3 of the article 30. For instance, one might expect a total of around 200 activations of the aerosol generator 4 (corresponding to 200 inhalations) from a two ml volume of liquid aerosol-generating material. The threshold value may be set to an amount greater than the average, for example, between 10% to 50% greater, such as 25% greater. For example, the threshold value may be set to 250. With the threshold set in this way, the threshold acts as a fail-safe to prevent extended usage of the article but at the same time avoid or reduce instances where, for example, users are prevented from using the article 30 due to the counter value exceeding the threshold value despite sufficient aerosol-generating material still being held in the storage area 3, simply because there may be slight variations in the actual amount of aerosol-generating material aerosolized per inhalation. A balance may be struck between setting the threshold too high (thus allowing prolonged usage for a greater period of time of potentially unauthorised aerosol-generating material) versus setting the threshold too low such that the aerosol generator 4 is prevented from activating even when there is still aerosol-generating material left in the article 30.

The threshold value acts not as a direct indication that the amount of aerosol-generating material in the storage area 3 is depleted (or approaching depletion), but rather as an indication of the usage of the article 30/the number of activations of the aerosol generator 4. Thus, in some implementations, there may be a separate mechanism within the article 30 or aerosol provision device 20 for tracking or measuring the amount of aerosol-generating material in the storage area 3 of the article 30 and controlling the operation of the aerosol generator 4 based on the measured or determined amount of aerosol-generating material in the storage area 3. For example, the article 30 may be provided with a suitable sensor, such as a capacitive sensor, capable of being used to detect the amount of aerosol-generating material in the storage area 3 of the article 30 and to prevent activation of the aerosol generator 4 if the sensor determines that the amount of aerosol-generating material in the storage area 3 is depleted or approaching depletion, regardless of the indication of usage stored in the readable element 30*a*. Accordingly, there may be scenarios where aerosol generator 4 is prevented from activating even though the indication of usage of the article 30 signifies that the aerosol generator 4 may be activated according to the method of FIG. 5 if the amount of aerosol-generating material in the storage area 3 is below a certain amount. The method of FIG. 5 may therefore operate independently of the separate mechanism for detecting the amount of aerosol-generating material held within the storage area 3.

For a full article 30, the counter value initially starts at zero and each activation of the aerosol generator 4 increases the counter value by one (or as described above, the counter starts at a higher value and is decremented by one for each activation of the aerosol generator 4). On the assumption that a user manually refills the article 30 prior to the counter value surpassing the threshold value (e.g., because the separate mechanism indicates the storage area 3 is depleted of aerosol-generating material or because the user decides to top-up the storage area 3 with aerosol-generating material after a few uses), the article 30 may continue to be used until the counter value stored in the readable element 30*a* is equal to or greater than the threshold value (or equal to or less than the threshold if the counter value decrements by one). As described above, when this occurs, the aerosol generator 4 is prevented from activating, even if there is sufficient aerosol-generating material in the storage area 3 for subsequent inhalations.

It should be clear from the above that should the user refill the article 30 manually, the presence of the indicator of usage stored in the readable element 30*a* of the article 30 acts to limit the further possible usage of the article 30 since the manual refill, as the indictor of usage continues to be updated even after the manual refill operation. Thus, even in the event that the article 30 is completely refilled, the amount of aerosol-generating material that has been input into the storage area 3 of that article 30 that can subsequently be aerosolized is limited. This is because manually refilling the article 30 does not cause the indicator of usage stored in the readable element 30*a* to be reset, whereas it should be clear from the above that a separate mechanism for determining or measuring the amount of aerosol-generating material in the article 30 may indeed be influenced by the manual refill performed by the user.

It should be appreciated that setting the threshold value to be as close as possible to the expected usage from the aerosol-generating material to a full storage area 3 may help to minimise the potential usage of any unauthorised aerosol-generating material that the user may manually insert into the article 30. Thus, while it has been described above that there may be a tolerance of between 10 to 50% of the average expected number of inhalations from a full article 30, in other examples no tolerance may be provided, or the threshold value may be set less than the average expected number of inhalations from a full article 30. In such examples, it may not be necessary to include a separate mechanism for determining or measuring the amount of aerosol-generating material within the article 30 as the aerosol generator 4 may be prevented from activating as a result of the comparison with the threshold value even when there is aerosol-generating material held in the storage area 3.

Turning now to FIG. 7, FIG. 7 shows a method for refilling the article 30 using a dock 50 according to the principles of the present disclosure.

The method begins at step S11. At step S11, the article 30 is coupled to the dock 50, and more specifically with the article port 56 of the dock 50 as appropriate and as described above. The article 30 may be in any state of refill or usage at this point. In most instances of genuine usage (i.e., without manual refilling having taken place), the article 30 is likely to be partially or completely depleted of aerosol-generating material and the indicator of usage of the readable element 30*a* is likely to not have surpassed the threshold value (or, more generally, indicate that the usage criteria has been met).

The method proceeds to step S12, where the controller 55 is configured to obtain an actual usage of the article 30. In this step, the dock 50 is configured to read the readable element 30*a* of the article 30, using the corresponding reader 56*a*, and obtain the indication of usage stored in the readable element 30*a*. As should be readily understood, the indication of usage stored in the readable element 30*a* represents an actual usage of the article 30 (e.g., how many times this article, or the aerosol generator 4, has been activated). As discussed in many of the examples above, the indicator of usage may be a counter value, and thus the controller 55 receives said counter value from the readable element 30*a*.

The method then proceeds to step S13 where the controller 55 is configured to obtain or determine an expected usage of the article 30. The expected usage of the article 30 may be obtained in any suitable manner.

For instance, in some implementations, obtaining the expected usage of the article 30 includes measuring or determining the amount of aerosol-generating material currently held within the article 30 docked in the article port 56. For instance, the article port 56 may comprise a pair of capacitor plates (not shown) arranged either side of the article port 56 such that when the article 30 is coupled to the article port 56 at least a part of the storage area 3 is located between the capacitor plates. By measuring the capacitance between the capacitor plates when the article 30 is at least partially located between the capacitor plates, an indication of the amount of aerosol-generating material within the storage area 3 can be obtained (wherein the dielectric between the capacitor plates is dependent on the proportion of aerosol-generating material and the proportion of air between the capacitor plates). Other techniques for determining the amount of aerosol-generating material in the article 30, such as weighing the article using a suitable sensor, could alternatively be employed. The way in which the amount of aerosol-generating material is measured or determined is not of primary significance to the principles of the present disclosure.

Once the amount of aerosol-generating material in the article 30 has been measured or determined, the controller 55 may then determine the expected usage. This may be determined using the assumption that the article 30/storage area 3 was completely filled either from manufacture or from the previous refilling operation. On this assumption, one can determine an expected usage based on subtracting the amount of aerosol-generating material currently held in the article 30 from the default filled amount and translating this difference into an indication of usage. For example, using the assumption that a two ml volume of liquid aerosol-generating material corresponds to a full storage area 3, and that one might expect an average of around 200 inhalations from such a volume of aerosol-generating material, if the measured amount of aerosol-generating material is e.g., 1.5 ml, this equates to a difference of 0.5 ml. Using the mapping above, where 1 inhalation equates to 0.01 ml of liquid, this measured amount of 1.5 ml of aerosol-generating material in the storage area 3 translates to an expected average of 50 inhalations. Thus, in this instance, the controller 55 would determine that 50 inhalations represents the expected usage of the article 30.

Additionally, or alternatively, the readable element 30*a* may additionally store an indication of the amount of aerosol-generating material held in the storage area 3 of the article 30 from a previous (re) fill operation. That is to say, during a given filling or refilling operation, the readable element 30*a* may be updated to include an indication of the amount of aerosol-generating material included in the storage area 3 of the article 30 after that filling or refilling operation, and this stored indication of the amount after refilling represents the indication of the amount of aerosol-generating material from a previous (re) filling operation in the immediately proceeding refilling operation. For instance, during manufacture of the article 30, the article 30 may be filled with say 1.9 ml of liquid aerosol-generating material and this value may be recorded in the readable element 30*a* during manufacture. In other examples, when the article 30 is coupled to the refill dock 50 for refilling, the dock 50 and/or user may choose to partially refill the article 30, e.g., to 1.5 ml. In respect of the dock 50, the recorded amount of aerosol-generating material stored in the storage area 3 after filling may be based solely on the amount of aerosol-generating material transferred to the article 30 (e.g., by measuring the flow of aerosol-generating material to the article 30 along conduit 58 over time, and assuming the article is empty upon the start of the refilling operation), based on a sum of the amount of aerosol-generating material transferred to the article 30 with the amount of aerosol-generating material held in the storage area 3 prior to the refilling as determined, e.g., by measuring the capacitance of the article as described above, or simply by measuring the amount of aerosol-generating material held in the article 30 after the refilling operation (e.g., using the capacitor plates described above). Hence, an indication of the amount of aerosol-generating material held in the storage area 3 of the article 30 from a previous (re) fill operation may be stored in the readable element 30*a*.

The indication of the amount of aerosol-generating material held in the storage area 3 of the article 30 from a previous (re) fill operation may be used to more accurately determine the expected usage of the article 30 (in place of assuming an article is completely full from a previous refilling operation when docked with the article port 56 of the dock 50). In this case, the dock 50 may subtract the current measured amount of aerosol-generating material in the storage area 3 from the amount of aerosol-generating material from a previous operation.

Once the expected usage of the article 30 has been obtained or determined, the method proceeds to step S14, where the controller 55 of the dock 50 is configured to compare the actual usage with the expected usage. At step S14, the question is asked as to whether the actual usage is within a predetermined range of the expected usage. The predetermined range may be set to encompass slight deviations resulting either from any errors associated with the mapping of the expected usage to the actual usage or from the mere fact that these two quantities are determined differently and thus subject to slight variation. For example, two users may not be the same and thus it may transpire that the assumption of an average of X ml of aerosol-generating material used per inhalation is actually X±Δ ml for a given user, where Δ is a small quantity. The predetermined range may be set as an absolute value (e.g., ±10, 20, 30, etc. inhalations) or as a relative value (e.g., 5%, 10%, 15%, etc. of the actual usage). The actual predetermined range may be determined via mathematical modelling or empirical testing. In other implementations the predetermined range may be set quite strictly, for example, to accommodate only a one or two inhalation deviation. As should be appreciated, in the event that the actual usage and expected usage are both represented as counter values, the controller 55 is configured to determine whether the actual usage is within the predetermined numerical range of the expected usage.

At step S14, if the controller 55 determines that the actual usage is within a predetermined range of the expected usage (i.e., a YES at step S14), then at step S15, the controller 55 is configured to permit the refilling of the article 30 from the refill reservoir 40 using any of the approaches described above. In some implementations, it may well be that the controller 55 is required to perform additional checks before refilling may actually commence, e.g., determining whether the aerosol-generating material in the refill reservoir 40 is compatible with the aerosol-generating material in or previously contained in the article 30. However, as a result of a YES determination at step S14, refilling is not prevented on the basis of the comparison between the actual usage and expected usage.

Once refilling has been completed (or during the refilling process, or when the refilling process is initiated), the controller 55 is configured to reset the indicator of usage stored in the readable element 30*a* at step S16. For example, the controller 55 may reset the counter value to a suitable starting value (e.g., either zero if the counter increments by one, or a high number if the counter decrements by one). In this way, when the article 30 is removed from the dock 50, with at least a partially refilled storage area 3, the indication of usage now indicates the usage of the article 30 with respect to the refilled quantity of aerosol-generating material in the storage area 3. Accordingly, it should be appreciated that refilling the article 30 with the dock 50, using authorised aerosol-generating material, permits multiple uses of the article (and the aerosol generator 4), even beyond the total number that would otherwise have been limited by the threshold value.

It should also be noted that at step S16, if suitable, the controller 55 may cause the amount of aerosol-generating transferred to the article 30 or the amount of aerosol-generating material stored in the storage area 3 after refilling to be stored in the readable element 30*a* of the article 30.

The process described by FIG. 7 is then effectively repeated from step S11 once the user is ready to refill the article a subsequent time.

Conversely, if at step S14, it is determined that the actual usage is outside of a predetermined range of the expected usage, then the method may proceed to any one or all of steps S17 to S20.

Before discussing steps S17 to S20, it should be appreciated that if the user manually refills the article 30, because the readable element 30*a* is not reset during such a manual refilling process there is a strong probability of a discrepancy arising between the expected usage and actual usage. For instance, if the user completely uses a full storage area 3 of aerosol-generating material, then manually refills the storage area 3 with another full storage area 3 of unauthorised aerosol-generating material and continues to use article 30, the actual usage (i.e., the indicator of usage of the readable element 30*a*) may signify that around say 250 to 300 inhalations have been consumed when the article 30 is either prevented from activating (due to a comparison with the threshold value, e.g., as at step S2 of FIG. 5) and/or when the user chooses to couple the article 30 to the dock 50. In this case, the expected usage, determined by measuring the aerosol-generating material stored in the article 30, would show a storage area 3 that is at least half-full (e.g., corresponding to an expected usage of 50 to 100 inhalations). In this case, the discrepancy between the actual and expected usage is on the order of 150 to 200 inhalations, well outside the predetermined range permitted at step S14. Thus, by providing a comparison between the actual usage and the expected usage, instances of manual refilling can be determined by the controller 55 of the dock 50. Subsequently, steps can be taken to alert a user and/or prevent further usage of the article 30.

At step S17, the dock 50 or controller 55 is configured to prevent refilling of the article 30 with aerosol-generating material from the refill reservoir 40 in response to the determination that the actual usage is not within a predetermined range of the expected usage (i.e., a NO at step S14). In this instance, the article 30 may be treated as contaminated (as the aerosol-generating material manually refilled is unknown to the dock 50, and thus cannot be determined whether it complies with the relevant regulations or not). Thus, permitting continued use of the article 30 by allowing the article 30 to be refilled could lead to harm/damage to the article 30 and/or the user.

Additionally, or alternatively, at step S18, the dock 50 or controller 55 is configured to disable the article 30. In this regard, similarly to step S17, the article 30 is considered contaminated but an additional step to disable the article 30 to prevent the aerosol generator 4 from ever being activated again may be taken (noting that unlike step S17, if the counter value of the readable element 30*a* has not yet surpassed the threshold value, the aerosol generator 4 may still be used if the article 30 is manually refilled for a further time). For example, the article 30 may include a fuse (or the like) or a permanent switch, which may be blown or activated by the controller 55 to prevent the aerosol generator 4 from receiving power from the aerosol provision device 20. Alternatively, the controller 55 may alter the algorithm within the control circuitry of the article (if present), e.g., by setting the indication of usage to value that always surpasses the threshold or by adjusting the threshold (e.g., to zero, in the case that the counter value counts up from zero to a higher number). In this way, the article 30 is prevented from being used in the future.

At step S19, an alert may be provided to the user, e.g., via a suitable user interface on the dock 50, or via a user device communicatively coupled to the dock (e.g., a smartphone or the like), to signify that it has been determined that the actual usage is outside of a predetermined threshold of the expected usage. The alert may be in the form of a visual signal (e.g., a text message or symbol on a display, a flashing LED, etc.), an audible signal (e.g., a sound or voice message played through a speaker), or a haptic signal (e.g., a vibration provided through a haptic motor on the user's smartphone). In any case, the user is subsequently alerted to the fact that there has been a determination that the actual usage and expected usage do not correlate. The user may appropriately dispose of the article 30 and insert a different article 30 to the dock 50.

At step S20, in response to the determination that the actual usage is not within a predetermined range of the expected usage (i.e., a NO at step S14), an account linked to the dock 50 may be notified of the fact that there has been a determination that the actual usage and expected usage do not correlate. For instance, a user may be required to create an account which links a user identifier to an email address or other contact information, or to an app on a smartphone registered to the user, for example. When using the dock 50, the refilling operation may require the user to link their account to the dock 50 during the refilling process (e.g., by manually inserting login details via a UI on the dock 50 or by linking the smartphone to the dock via an app). Providing a notification to an account of the user of the article 30/dock 50, may serve to help trace and/or ban repeat offenders (i.e., users who continually manually refill different articles 30).

Thus, when the determination of step S14 indicates that the actual usage of the article 30 does not fall within a predetermined range of the expected usage (or vice versa), several steps may be taken to prevent usage of the article 30 and/or to alert the user that unauthorised activities (i.e., manual refilling) has occurred. While in principle any one of steps S17 to S20 may be implemented, in some implementations, at least one of step S17 or S18 is implemented to prevent further use of the article 30.

Thus, it has been described above that by use of a readable element 30*a* storing an indication of usage of the article 30, a dock 50 (or refilling unit) is able to detect activity associated with manual refilling of the article 30 and subsequently prevent further refilling or use of the article 30 which may have been compromised due to being exposed to unauthorised aerosol-generating material. In this way, the safety of users and/or of articles and aerosol provision devices can be improved by only being substantially used with authorised aerosol-generating material, avoiding or reducing the chances of damage or harm due to aerosolizing unauthorised aerosol-generating material.

It has been described above that, in some implementations, the actual usage and expected usage take the form of a counter value signifying the actual or expected number of activations of the aerosol generator 4. However, it should be appreciated that the actual usage and expected usage may instead be represented as e.g., amounts of aerosol generating material. For example, the expected usage in some implementations is a difference in the current measured amount of the aerosol-generating material located in the article 30 and the amount of aerosol-generating material in the article 30 after the previous refilling operation. This may be represented in ml or any other suitable unit of measurement, e.g., g. The actual usage may be based on converting the counter value described above to a representative amount of aerosol generating material, e.g., by multiplying the counter value by a suitable mapping. The comparison step of S14 therefore compares amounts of aerosol-generating material.

Equally, it has been described that the counter value above may signify the number of activations of the aerosol generator 4. However, the counter value may be arranged to count a usage based on alternative metrics/parameters. For example, the counter value may count seconds or milliseconds that the aerosol-generator is activated for (e., if the aerosol provision device is button activated, based on the time the button is pressed). The expected usage may be calculated using a mapping for the corresponding similar metric/parameter. The way in which actual and expect usage is determined is not limited to a counter value, and other suitable techniques may be employed.

Additionally, it has been described above that, in some implementations, the article 30 may store an indication of the amount of aerosol-generating material transferred to the article 30 in a previous (re) filling operation and/or an amount of aerosol-generating material stored in the article 30 after a refilling operation. However, in some implementations, the readable element 30*a* may not be suitable for, or capable of, storing such information. In such cases, the dock 50 may be configured to associate the indication of the amount of aerosol-generating material transferred to the article 30 in a previous (re) filling operation and/or an amount of aerosol-generating material stored in the article 30 after a refilling operation with an identifier identifying the article 30. The identifier identifying the article 30 may be any suitable identifier that uniquely identifies the article (e.g., a digital code stored in the readable element 30*a* or another readable element, or a pattern, such as a bar code, printed on the surface of the article 30 and readable by the dock 50). When the article 30 is subsequently docked with the dock 50, at step S13 of FIG. 7, the dock 50 may be additionally configured to recall the indication of the amount previously transferred from a memory located in the dock 50 based on the unique identifier read from the article 30. Additionally, or alternatively, the dock 50 may transmit the indication of the amount of aerosol-generating material transferred to the article 30 in a previous (re) filling operation and/or an amount of aerosol-generating material stored in the article 30 after a refilling operation along with the unique identifier of the article 30 to the cloud or a server. Subsequently, step S13 of FIG. 7 may require the dock 50 to retrieve the indication of the amount of aerosol-generating material transferred to the article 30 in a previous (re) filling operation and/or an amount of aerosol-generating material stored in the article 30 after a refilling operation from the cloud/server based on the unique identifier. This may enable the article 30 to be refilled using different docks 50 (for example a home dock and a work dock) and avoid instances where the dock(s) 50 determine the expected usage and actual usage do not correspond.

Although it has primarily been described above that the refilling device/dock 50 is provided to transfer source liquid from a refill reservoir 40 to an article 30, as discussed, other implementations may use other aerosol-generating materials (such as solids, e.g., tobacco). The principles of the present disclosure apply equally to other types of aerosol-generating material, and suitable refill reservoirs 40 and articles 30 for storing/holding the aerosol-generating materials, and a suitable transfer mechanism 53, may accordingly be employed by the skilled person for such implementations.

Furthermore, although it has been described that the aerosol generator 4 is located/comprised in the article 30, it should be appreciated that the aerosol generator 4 may form part of the aerosol provision device 20 and the article 30, containing any aerosol-generating material, is configured to allow the aerosol-generating material to be transferred/moved/directed to the aerosol-generator of the aerosol provision device 20.

Hence, there has been described a refilling unit for refilling a refillable article for use with an aerosol provision device for generating aerosol from aerosol-generating material stored within the refillable article, the refilling unit including: an article port for receiving at least the article; an information reader configured to read a readable element for storing information corresponding to the article; and a controller for controlling operations of the refilling unit, wherein the controller is configured to: determine or obtain an actual usage of the article based on an indication of usage of the article read from the readable element of the article; determine or obtain an expected usage of the article; and compare the actual usage with the expected usage and, if the actual usage is within a predetermined range of the expected usage, permit the refilling unit to refill the article with aerosol-generating material. Also described is an article, aerosol provision device, system and method.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The present disclosure relates to an apparatus that is configured to interact with an aerosol provision system, such as the aerosol provision system 10 described above. More specifically, the disclosure relates to an apparatus which is able to receive/couple to/engage with the aerosol provision system 10 and perform actions such as refilling the reservoir 3 (storage area) of the article 30 with aerosol-generating material and/or electrically recharging the power source 7 of the aerosol provision device 20. The apparatus may be termed herein a refilling device/unit/station, recharging device/unit/station, recharging and refilling device/unit/station, or simply dock or docking device/unit/station.

The docking unit described herein is provided to perform both a refilling operation (that is, refilling an article 30 with aerosol-generating material) and a recharging operation (that is, recharging a power source 7 of the aerosol provision device 20); however, the present disclosure is not limited to docking units capable of performing both functions and, in other implementations, the docking unit may be configured to perform either one of a refilling operation or a recharging operation. Additionally, while the focus herein is on the refilling and recharging operations, docking units according to other implementations may be configured to perform other operations associated with the aerosol provision system 10, such as configuring parameters or settings of the aerosol provision device. Thus, the principles of the present disclosure apply broadly to docking units configured to interact with an aerosol provision system.

In respect of the refilling operation, the docking unit may be configured to cause the refilling of a storage area for aerosol-generating material in an aerosol provision system, whereby a user is enabled to conveniently provide a system with fresh aerosol generating material when a previous stored quantity has been used up. The docking unit is configured to receive an aerosol provision system, or more conveniently, the article from an aerosol provision system having a storage area which is empty or only partly full, plus a larger reservoir holding aerosol-generating material. A fluid communication flow path is established between the larger reservoir and the storage area, and a controller in the docking unit controls a transfer mechanism (or arrangement) operable to move aerosol-generating material along the flow path from the larger reservoir in the refilling device to the storage area. The transfer mechanism can be activated in response to user input of a refill request, or activation may be automatic in response to a particular state or condition of the docking unit detected by the controller. For example, if both an article and a larger reservoir are correctly coupled to the docking unit, refilling may be carried out. Once the storage area is replenished with a desired quantity of aerosol-generating material (the storage area is filled or a user specified quantity of material has been transferred to the article, for example), the transfer mechanism is deactivated, and aerosol-generating material transfer ceases. Alternatively, the transfer mechanism may be configured to automatically dispense a fixed quantity of aerosol generating material in response to activation by the controller, such as fixed quantity matching the capacity of the storage area.

In respect of the recharging operation, the docking unit may be configured to cause the recharging of a power supply in an aerosol provision system, whereby a user is enabled to conveniently recharge an otherwise depleted or partially depleted power source of an aerosol provision device. The docking unit is configured to receive an aerosol provision system, or more conveniently, the aerosol provision device from an aerosol provision system. An electrical connection is established between the power source of the aerosol provision device and the power source of the docking unit, and a controller controls the flow of electrical power to the power source of the aerosol provision device. The flow of power can be activated in response to user input of a recharge request, or activation may be automatic in response to a particular state or condition of the docking unit detected by the controller (e.g., when the aerosol provision device is coupled to the docking unit and a depleted power source of the aerosol provision system is detected). Once the power source of the aerosol provision device is replenished with sufficient electrical power (e.g., the power source is fully recharged), the supply of power is deactivated, and the power source of the aerosol provision device stops recharging.

Figure 8:
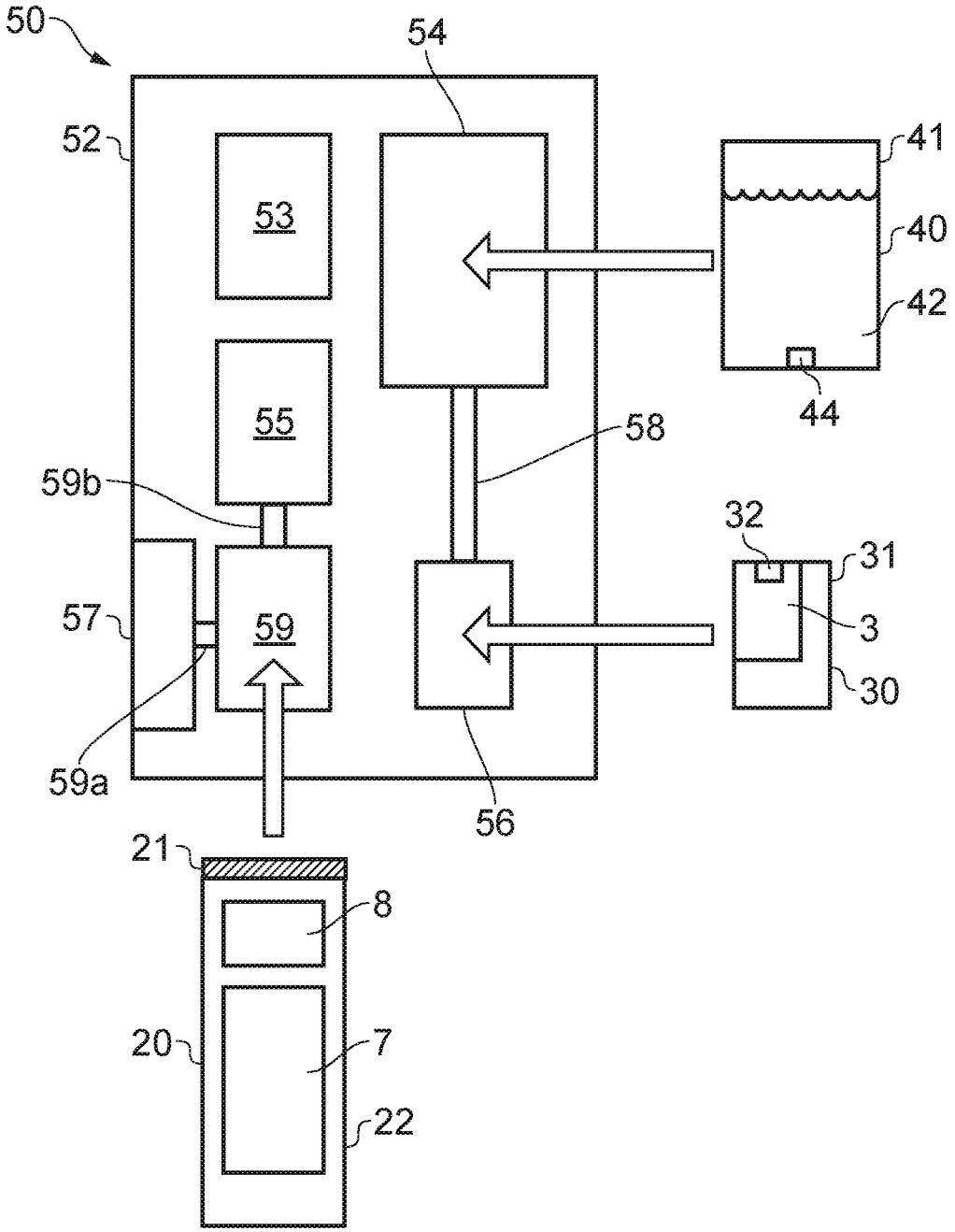
FIG. 8 shows a simplified schematic representation of a docking unit in which embodiments of the present disclosure can be implemented.

FIG. 8 shows a highly schematic representation of an example docking unit. The docking unit is shown in a simplified form only, to illustrate various elements and their relationship to one another. More particular features of one or more of the elements with which the present disclosure is concerned will be described in more detail below.

The docking unit 50 will be referred to hereinafter for convenience as a "dock". This term is applicable since a refill reservoir, an article, and an aerosol provision device are received or "docked" to/in the docking unit during use. The dock 50 comprises an outer housing 52. The dock 50 is expected to be useful for refilling of articles and/or recharging of aerosol provision devices in the home or workplace (rather than being a portable device or a commercial device, although these options are not excluded). Therefore, the outer housing 52, made for example from metal, plastics or glass, may be designed to have a pleasing outward appearance such as to make it suitable for permanent and convenient access, such as on a shelf, desk, table or counter, etc. It may be any size suitable for accommodating the various elements described herein, such as having dimensions between about 10 cm and 20 cm, although smaller or larger sizes may be possible.

The dock 50 comprises three cavities or ports 54, 56, 59. The ports 54, 56, 59 may be defined by the outer housing 52 of the dock 50, for example as recessed portions in the outer housing 52. Alternatively the ports 54, 56, 59 may be provided within the housing 52 with the ports being accessible through the housing 52, e.g., via an aperture or the like.

A first port 54 is shaped and dimensioned to receive and interface with a refill reservoir 40. The first or refill reservoir port 54 is configured to enable an interface between the refill reservoir 40 and the dock 50, so might alternatively be termed a refill reservoir interface. The refill reservoir port 54 is consequently designed to couple or engage with the refill reservoir 40 so may also be termed a refill reservoir engagement mechanism of the dock 50. Primarily, the refill reservoir port 54 is configured for moving aerosol-generating material out of the refill reservoir 40, but in some cases the interface may enable additional functions, such as electrical contacts and sensing capabilities for communication between the refill reservoir 40 and the dock 50 and determining characteristics and features of the refill reservoir 40.

The refill reservoir 40 comprises a wall or housing 41 that defines a storage space for holding aerosol-generating material 42. The volume of the storage space is large enough to accommodate many or several times the storage area/reservoir 3 of an article 30 intended to be refilled in the dock 50. A user can therefore purchase a filled reservoir 40 of a desired aerosol generating material (flavor, strength, brand, etc.), and use it to refill an article 30 multiple times. A user could acquire several reservoirs 40 of different aerosol generating materials, so as to have a convenient choice available when refilling an article 30. The refill reservoir 40 includes an outlet orifice or opening 44 by which the aerosol generating material 42 can pass out of the refill reservoir 40.

A second port 56 is shaped and dimensioned to receive and interface with an article 30. The second or article port 56 is configured to enable an interface between the article 30 and the dock 50, so might alternatively be termed an article interface. The article port 56 is consequently designed to couple or engage with the article 30 so may also be termed an article engagement mechanism of the dock. Primarily, the article port 56 is for receiving aerosol-generating material into the article 30, but in some cases the interface may enable additional functions, such as electrical contacts and sensing capabilities for communication between the article 30 and the dock 50 and determining characteristics and features of the article 30.

The article 30 itself comprises a wall or housing 31 that has within it (but possibly not occupying all the space within the wall 31) a storage area or reservoir 3 for holding aerosol-generating material. The volume of the storage area 3 is many or several times smaller than the volume of the refill reservoir 40, so that the article 30 can be refilled multiple times from a single refill reservoir 40. The article 30 also includes an inlet orifice or opening 32 by which aerosol-generating material can enter the storage area 3. Various other elements may be included with the article 30, as discussed above with regard to FIG. 1.

The housing 52 also accommodates a fluid conduit 58, being a passage or flow path by which the reservoir 40 and the storage area 3 of the article 30 are placed in fluid communication, so that aerosol-generating material can move from the refill reservoir 40 to the article 30 when both the refill reservoir 40 and the article 30 are correctly positioned in the dock 50. Placement of the refill reservoir 40 and the article 30 into the dock 50 locates and engages them such that the fluid conduit 58 is connected between the outlet orifice 44 of the reservoir 40 and the inlet orifice 32 of the article 30. Note that in some examples, all or part of the fluid conduit 58 may be formed by parts of the refill reservoir 40 and the article 30, so that the fluid conduit is created and defined only when the refill reservoir 40 and/or the article 30 are placed in the dock 50. In other cases, the fluid conduit 58 may be a flow path defined within the housing 52 of the dock 50, to each end of which the respective orifices are engaged. The dock 50 also includes an aerosol generating material transfer mechanism, arrangement, or apparatus 53, operable to move or cause the movement of fluid out of the refill reservoir 40, along the conduit 58 and into the article 30. Various options are contemplated for the transfer mechanism 53, but by way of an example, the transfer mechanism 53 may comprise a fluid pump, such as a peristaltic pump.

Further details relating to the fluid conduit will now be described. As noted above, the fluid conduit may be wholly or partly formed by parts of the reservoir 40 and the article 30. In particular, an example arrangement for the fluid conduit 58 is a nozzle by which fluid aerosol generating material is dispensed from the refill reservoir 40. The nozzle may be provided as an element of the dock 50, such that the outlet orifice of the refill reservoir 40 is coupled to a first end of the nozzle when the refill reservoir 40 is installed in the dock. Alternatively, the nozzle may be embodied as an integral part of the refill reservoir 40, to provide the outlet orifice. This associates the nozzle only with the particular reservoir and its contents, thereby avoiding any cross-contamination that may arise from using reservoirs of different aerosol-generating material with the same nozzle. The nozzle is engaged into the inlet orifice of the article 30 in order to enable fluid transfer from the reservoir into the article. The engagement may be achieved by movement of the article towards the refill reservoir, or vice versa, for example, when both have been installed in the dock.

FIG. 3 shows a schematic representation of a nozzle arranged for use as a fluid conduit. A refill reservoir 40 containing a source liquid 42 has a nozzle 60 arranged as its outlet orifice, a first end or proximal end 61 of the nozzle 60 being adjacent the refill reservoir 40. The nozzle may be integrally formed with the refill reservoir 40 by molding of a plastics material or 3D printing, for example. This ensures a leak-free juncture between the nozzle 60 and the housing 41 of the refill reservoir 40. Alternatively, the two parts may be formed separately and joined together afterwards, such as by welding, adhesive, a screw-thread or push-fit coupling, or other approach. The nozzle 60 has a tubular elongate shape, and extends from the first end 61 to a second or distal end 62, remote from the refill reservoir 40, which acts as the fluid dispensing point. Fluid is retained in the reservoir by, for example a valve (not shown) at or near the proximal end 61, which is opened when fluid transfer to the article 30 commences. In other cases, surface tension may be sufficient to retain the fluid, for example if the bore of the nozzle 60 is sufficiently small. The distal end 62 is inserted into or otherwise engages with the inlet orifice 32 of the article 30, and in this example extends directly into the storage area 3 of the article 30. In other examples, there may be tubing, pipework or some other fluid flow path connecting the inlet orifice 32 to the interior of the storage area 3. In use, source liquid 42 is moved out of the refill reservoir 40 using the fluid transfer mechanism 53 of the dock 50, along a fluid channel defined by the nozzle 60 (acting as the fluid conduit) from the proximal end 61 to the distal end 62, where it reaches a fluid outlet of the nozzle and flows into the storage area 3, in order to refill the article 30 with liquid aerosol-generating material.

With reference back to FIG. 8, a third port 59 is shaped and dimensioned to receive and interface with an aerosol provision device 20. The third or device port 59 is configured to enable an interface between the aerosol provision device 20 and the dock 50, so might alternatively be termed a device interface. The device port 59 is designed to engage with the aerosol provision device 20 so may also be termed an aerosol provision device engagement mechanism of the dock 50. Primarily, the device interface is for receiving and holding the aerosol provision device 20. In the present example, the device interface is also configured for supplying power to the aerosol provision device 20 via electrical contacts. The device interface may also be provided for data/information/control signal exchange between the dock 50 and the aerosol provision device 20 or vice versa. In some cases the interface may also provide electrical contacts and sensing capabilities for communication between the device 20 and the dock 50.

The device 20 itself comprises a wall or housing 22. FIG. 8 shows the device housing 22 having within it the controller 8 and power source 7, although various other components may be included, such as those shown in FIG. 1, but are omitted here for clarity.

Access to the reservoir port 54, the article port 56, and the device port 59 can be by any convenient means, and the means for each port 54, 56, 59 may be the same of different on any particular dock 50. The housing 52 of the dock 50 may comprise recessed portions which define the respective ports, with any associated electrical and/or mechanical engagement mechanisms located in the respective recessed portions. Apertures may be provided in the housing 52 of the dock 50, through which the refill reservoir 40, the article 30, and the aerosol provision device 20 can be placed or pushed. The refill reservoir 40, the article 30, and/or the device 20 may be completely contained within the respective apertures or may partially be contained such that a portion of the refill reservoir 40, the article 30 and/or device 20 protrude from the respective ports 54, 56, 59. In some instances, doors or the like may be included to cover the apertures to prevent dust or other contaminants from entering the apertures. When the refill reservoir 40, the article 30 and/or the device 20 are completely contained in the ports 54, 56, 59, the doors or the like might require to be placed in closed state to allow refilling and/or recharging to take place. Doors, hatches and other hinged coverings, or sliding access elements such as drawers or trays, might include shaped tracks, slots or recesses to receive and hold the refill reservoir 40, the article 30, or the device 20 which bring the refill reservoir 40, the article 30 or device 20 into proper alignment inside the housing 52 when the door, etc. is closed. These and other alternatives will be apparent to the skilled person, and do not affect the scope of the present disclosure.

The dock 50 includes a controller 55, which may also be termed the dock controller 55, which is operable to control components of the dock 50. The controller 55 is, in one aspect, configured to generate and send control signals to operate the transfer mechanism 53. As noted, this may be in response to a user input, such as actuation of a button or switch, or automatically in response to both the refill reservoir 40 and the article 30 being detected as present inside their respective ports 54, 56. The controller 55 may therefore be in communication with contacts and/or sensors (not shown) at the ports 54, 56 in order to obtain data from the ports and/or the refill reservoir 40 and article 30 that can be used in the generation of control signals for operating the transfer mechanism 53. The controller 55 may comprise a microcontroller, a microprocessor, or any configuration of circuitry, hardware, firmware or software as preferred; various options will be apparent to the skilled person.

The dock 50 also includes a power source 57 to provide electrical power to the dock 50, for example to the controller 55, as well as any further components that require power (e.g., the transfer mechanism 53 if the transfer mechanism 53 is electrically powered). Since the dock 50 may be for permanent location in a house or office, the power source 57 may comprise a socket for connection of an electrical mains cable to the dock 50, so that the dock 50 may be "plugged in" to mains electricity. Any suitable electrical converter to convert mains electricity to a suitable operational supply of electricity to the dock 50 may be provided, either on the mains cable or within the dock 50. Alternatively, the power source 57 may comprise one or more batteries, which might be replaceable or rechargeable, and in the latter case the dock 50 may also comprise a socket connection for a charging cable adapted to recharge the battery or batteries while housed in the dock.

As shown in FIG. 8, the device 20 engages with the port 59, and more specifically using the engagement element 21 of the device 20. The engagement element 21 of the device 20 is therefore configured to engage with either the article 30 or alternatively with the port 59 of the dock 50 when the device 20 is decoupled from the article 30. The engagement element 21 provides a mechanical and electrical connection between the dock 50 and the device 20 (via suitable electrical contacts in the device port 59, not shown). The electrical connection may be provided for the reasons stated above, e.g., the transfer of power and/or the transfer of data. In other implementations, the device 20 may comprise a separate electrical contact provided at the base of the device 20, such as a microUSB port, USB-C port, etc., allowing coupling to the device port 59 instead of engagement element 21. In other implementations, the electrical connection for power and/or data transfer may be implemented via wireless means with the device 20 and dock 50 comprising suitable antennas and circuitry accordingly.

In either case, the aerosol provision device 20 includes a docking unit engagement mechanism for engaging mechanically/physically and, optionally, electronically with the dock 50. The docking unit engagement mechanism may comprise any suitable mechanical mechanism for allowing coupling between the aerosol provision device 20 and device port 59 (aerosol provision device engagement mechanism) and, by way of example, may include a screw-thread, a bayonet connection, a latching mechanism, a magnetic coupling element (e.g., a magnet), or a press-fit connection. In some implementations, the device port 59 may be configured to receive the aerosol provision device 20 and support the aerosol provision device 20 in a suitable position under the influence of gravity. For example, the device port 59 may be a recessed portion of the housing 52 of the dock 50 having a wall approximately perpendicular to a flat base section of the recessed portion. The wall may be sufficiently tall (or the recessed portion may be sufficiently deep) to allow the device 20 to sit within the device port 59. The device port 59 and the housing 22 of the device 20 may be suitably shaped such that the housing 22 of the device 20 rests against the wall of the recessed portion, thereby supporting the device 20.

In the examples described herein, the device port 59 comprises a recessed portion with a wall that allows for the device 20 to be supported in the port 59, in addition to a USB (e.g., USB-C) plug/socket with the device 20 comprising the reciprocal USB socket/plug. The USB plug/socket may also provide additional mechanical engagement between the dock 50 and the device 20 as well as providing an electrical connection.

As shown in FIG. 8, the power source 57 of the dock 50 is electrically connected to the device port 59 via suitable power wiring 59*a*. Although the power wiring 59*a* is shown as directly connecting the power source 57 and device port 59, the power wiring 59*a* may be coupled to the controller 55 such that the controller 55 may control the flow of power to the device port 59 and, ultimately, to the power source 7 of the device 20. Any suitable control scheme may be implemented for controlling the flow of power, as described above. The device port 59 and/or the device 20 may comprise suitable sensors for determining when the power source 7 of the device 20 is sufficiently charged and subsequently provide signals to the controller 55 to stop supply of power in such an event.

Additionally, FIG. 8 shows data wiring 59*b* coupling the controller 55 to the device port 59. The data wiring 59*b* is provided for supplying data signals/information signals to the device 20 from controller 55 or for receiving data signals/information signals from the device 20 from controller 8, when the device 20 is engaged with the device port 59.

In accordance with an aspect of the present disclosure, the aerosol provision device comprises a feedback mechanism for providing feedback to a user. When the aerosol provision device is engaged with the docking unit, the feedback mechanism of the aerosol provision device is controlled to provide feedback relating to the docking unit. That is, the feedback mechanism of the aerosol provision device is controlled to provide feedback to the user indicative of the status of the docking unit. Providing feedback pertaining to the docking unit using the feedback mechanism on the device itself may be advantageous for several reasons, including providing a reduction in costs/manufacturing as no feedback mechanism (or a much simpler feedback mechanism) is necessary on the docking unit, as well as providing a more intuitive or more familiar user feedback mechanism to the user (the user need only familiarise themselves with one feedback mechanism, that of the aerosol provision device, as opposed to multiple different feedback mechanisms).

Figure 9A:
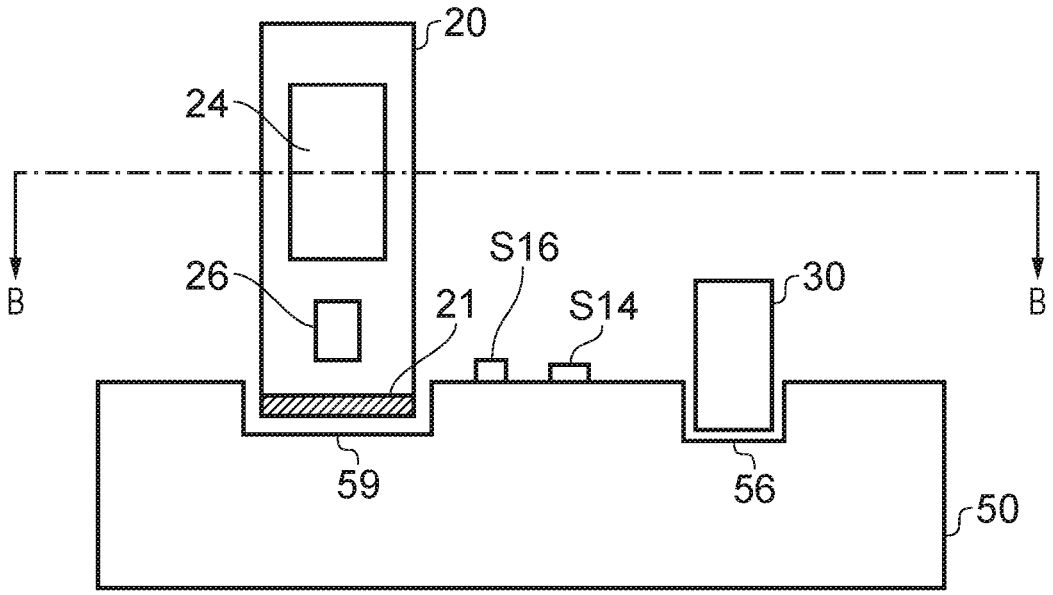
FIGS. 9A and 9B respectively schematically show two different views of a docking unit having an article and an aerosol provision device docked thereto, where the feedback mechanism(s) and user input mechanism(s) are specifically shown.
Figure 9B:
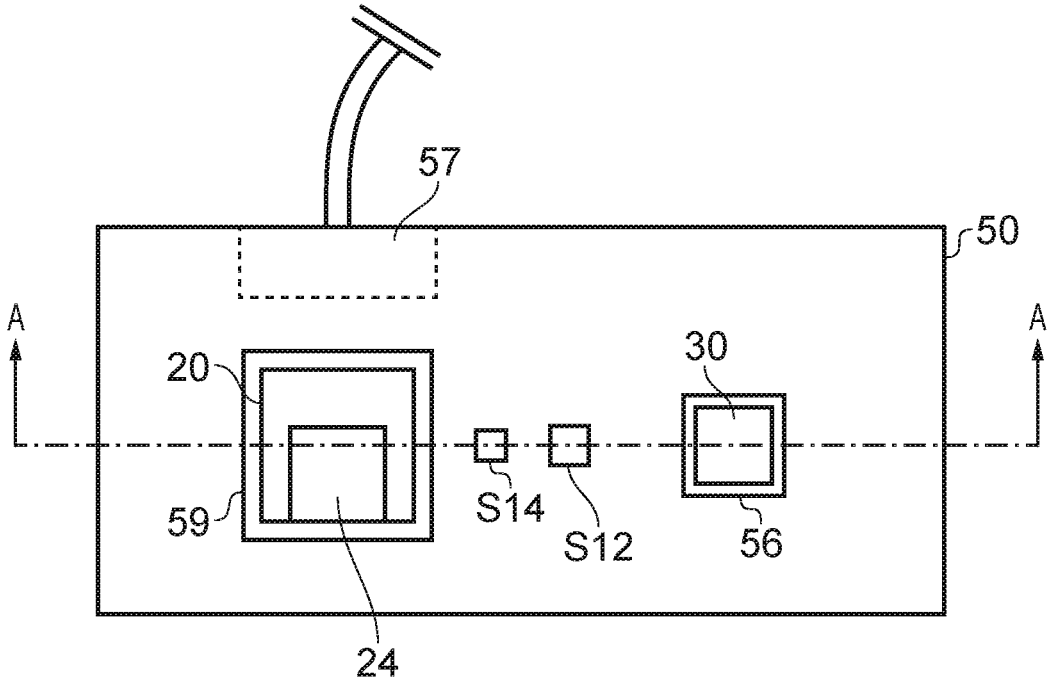

FIGS. 9A and 9B show, highly schematically, a system illustrating an aspect of the present disclosure, the system including the dock 50 with device 20 and article 30 installed in the respective ports 56, 59 of the dock 50. FIG. 9A shows a cross section of the system when viewed from the side, for example from a side that may be presented to a user when the dock 50 is mounted on a shelf or table top, while FIG. 9B shows the system when viewed from above.

The dock 50, aerosol provision device 20, and article 30 are substantially the same as the dock 50, aerosol provision device 20, and article 30 as described with respect to FIGS. 1, 8 and 3. FIGS. 9A and 9B show the respective components in schematic form and certain components are omitted for clarity, for example the transfer mechanism 53 and refill reservoir 40. The following discussion will focus on the features shown in FIGS. 9A and 9B.

As seen in FIGS. 9A and 9B, the dock 50 is configured to separately receive the article 30 and aerosol provision device 20 in the article port 56 and device port 59 respectively. As discussed previously, in other implementations, the aerosol provision system 10 (that is, the aerosol provision device 20 coupled to the article 30) may be received in a single port, although such implementations may require modification of the device 20 to accommodate the passage of aerosol-generating material through the device 20 body.

The aerosol provision device 20 is shown including the engagement element 21 engaged with the device port 59. Also shown is a feedback mechanism 24 and a user input mechanism 26.

The feedback mechanism 24 of the aerosol provision device 20 may comprise any mechanism which is suitable for providing feedback to a user. In the present example, the feedback mechanism 24 is a visual feedback mechanism configured to provide feedback visually to the user (i.e., the feedback is an optical signal to be perceived via sight). The feedback mechanism may comprise any suitable optical element to provide the visual feedback, e.g., one or more LEDs or other light emitting elements, or a display (such as an LCD or OLED screen). In other implementations, the feedback mechanism may comprise a speaker or the like configured to output an audio signal (to be perceived via hearing), or a haptic motor or the like configured to output a haptic signal (to be perceived via touch). The feedback mechanism may also comprise a combination of different types of feedback mechanisms, e.g., a visual mechanism and an audible mechanism may be combined to provide both optical and audio feedback signals to the user.

The user input mechanism 26 comprises any suitable user input mechanism arranged to receive a user input. The user input mechanism may comprise one or more actuatable buttons (e.g., a mechanical button), touch-sensitive elements, etc. The user input mechanism may allow the user to interact with the aerosol provision device 20 and, in particular, with the feedback mechanism 24. In some implementations, the user input mechanism 26 may be the same as user input mechanism 12. That is, the user input mechanism 12/26 may dually be used to control functions of the aerosol provision system 10 (such as aerosol generation) in addition to controlling aspects of the feedback mechanism 24. In some implementations, the user input mechanism 26 may be optional, particularly in implementations where no interaction with the feedback mechanism 24 is available or required.

In some implementations, the feedback mechanism 24 and user input mechanism 26 may be combined. For example, where the feedback mechanism 24 comprises a touch screen (e.g., a capacitive touch screen), the touch screen may function dually to provide feedback to the user as well as acting as a mechanism to receive a user input. The aerosol provision device 20 may be provided with suitable Combining the feedback mechanism 24 with the user input mechanism 26 may offer the ability to provide more complex information/feedback to the user while maximising surface space on the surface of the aerosol provision device 20.

The feedback mechanism 24 of the aerosol provision device 20 may be provided to convey information to the user regarding the status of the aerosol provision device 20. For instance, during use of the aerosol provision system 10 (i.e., when the article 30 is coupled to the aerosol provision device 20), the feedback mechanism 24 may be configured to provide feedback regarding any one or more of: the status of the power source 7 (e.g., an indication of the amount of charge remaining in the power source 7 and/or a power source health), the status of the aerosol generating material in the reservoir 3 of the article (e.g., the amount of aerosol generating material remaining in the reservoir 3 of the article 30 or the type (e.g., flavor/active concentration) of the aerosol-generating material in reservoir 3), any operational settings of the aerosol provision system 10 (e.g., the temperature of the heater 4, the power supplied to the heater 4), an operational mode of the aerosol provision device 20 (e.g., whether the device is in a boost mode where a greater volume of aerosol may be generated per inhalation), or any errors associated with any of the components of the aerosol provision system (e.g., heater 4 failure, controller 8 failure, power source 7 failure, etc.). The above are some examples of the possible types of feedback that may be provided to a user relating to the aerosol provision system 10 but it should be appreciated that this is not an exhaustive list of the feedback that may be provided to the user and the feedback that is provided will depend on the application at hand.

The user may interact with the aerosol provision device 20 using user input mechanism 12 or user input mechanism 26. The user may use the user input mechanism to perform certain functions, for example, such as starting aerosol generation or adjusting settings, etc. on the aerosol provision device 20. The user input mechanism 12 or 26 may also influence the feedback that is provided to the user, for example, if a specific operational mode is selected by the user using the user input mechanism 12 or 26, the feedback mechanism 24 may be controlled to provide an indication of the operational mode in response to the operational mode being selected. Control of the feedback mechanism 24 is performed via the control circuitry 8 (or a part thereof) and, if present, the user input mechanism 12/26 may provide the user input signal to the control circuitry 8 accordingly.

As seen in FIGS. 9A and 9B, the aerosol provision device 20 is arranged, when engaged with the dock 50, such that the feedback mechanism is positioned in a suitable location. In the case of a visual feedback element, the aerosol provision device 20 is arranged, when engaged with the dock 50, such that the visual feedback element is visible to a user. With reference to FIG. 9B, the visual feedback element 24 faces towards a front side of the dock 50 where the back side of the dock 50 is the side where the power cable extending from power source 57 (shown in dashed lines) extends from. When such a dock is positioned on a shelf, etc., the most likely arrangement is for the dock 50 to be positioned such that the front side faces outwardly from the shelf (e.g., into the room) with the power cable extending behind, such that the power cable is not visible (or not as visible). Broadly speaking, however, the feedback mechanism 24 is arranged such that the feedback mechanism 24 is not obstructed by the dock 50 or the device port 59 such that feedback mechanism 24 can sufficiently provide feedback to the user (e.g., such that the visual feedback mechanism 24 is visible).

The dock 50 shown in FIGS. 9A and 9B comprises a dock feedback mechanism 514 and a dock user input mechanism 516. The dock user feedback mechanism 514 and dock user input mechanism 516 are optional, and in some implementations, the dock 50 does not include any feedback mechanisms 514 and/or any user input mechanisms 516. The dock feedback mechanism 514, if present, is configured to convey information to the user regarding the status of the dock 50. The feedback mechanism 514 may be a more simple feedback mechanism than the feedback mechanism 24 on the aerosol provision device 20; for example, the dock feedback mechanism 514 may be an LED of the like arranged to indicate to the user when the device 20, article 30, and/or refill reservoir 40 is/are correctly docked into the dock 50. Other types of feedback mechanism, such as those described above in respect of feedback mechanism 24, may alternatively or additionally be used in other implementations. Additionally, the user input mechanism 516, if provided, may be configured to receive a user input from a user an control certain functions of the dock 50. The user input 516 may be provided, e.g., to turn on the dock 50 and place the dock 50 into a standby state (ready to perform the refill and/or recharge functions). The user input mechanism 516 may be any of the user input mechanisms discussed above in relation to user input mechanism 26.

In accordance with the principles of the present disclosure, the feedback mechanism 24 on the aerosol provision device 20 is controlled to provide feedback to the user indicative of the status of the dock 50 when the aerosol provision device 20 is docked in the dock 50 (or more specifically the device port 59).

In this respect, the status of the dock 50 may include any suitable status that may require or be desired to be communicated to the user. By way of example only, the status of the dock 50 may include one or more of: a status of the refilling operation (e.g., whether the refilling operation has been initiated, whether the refilling operation is in progress, whether the refilling operation is completed, or whether there is a problem with the refilling operation such as a problem with the transfer mechanism 53 or the fluid conduit 58), a status of the article 30 coupled to the dock 50 (e.g., whether the article 30 is empty/full, the amount of aerosol-generating material in the article 30, whether the article 30 is coupled to the dock 50, or the type of aerosol-generating material stored in the refill reservoir 40), a status of the refill reservoir 40 coupled to the dock 50 (e.g., whether the refill reservoir 40 is empty/full, the amount of aerosol-generating material in the refill reservoir 40, whether the refill reservoir 40 is coupled to the dock 50, or the type of aerosol-generating material stored in the refill reservoir 40), a status of the recharging operation (e.g., whether the recharging operation has been initiated, whether the recharging operation is in progress, whether the recharging operation is completed, or whether there is a problem with the recharging operation), a status of the power source 57 (e.g., whether the power source is functioning correctly, the charge of the power source (e.g., if the power source comprises batteries), a status of the controller 55 of the dock 50 (e.g., if the controller 55 is functioning correctly), and a status of any other component of the dock 50.

The dock 50 may include any suitable sensors or circuitry to determine or measure any suitable parameters to provide the feedback as indicated above. For example, the dock 50 may comprise an aerosol-generating material sensor (such as a capacitive sensor) arranged to determine the amount of (source liquid) aerosol-generating material stored in the article 30 or refill reservoir 40), or the dock 50 may comprise a sensor configured to detect the fluid flow along fluid conduit 58.

The controller 55 of the dock 50 may be arranged to detect the various parameters of the dock 50 (or components coupled to the dock 50) and generate information indicative of the status of the dock on the basis of the various detected parameters. This information may be referred to herein as "dock status information". In some implementations, the controller 55 is configured to transmit the dock status information to the aerosol provision device 20 (or more particularly the controller 8 of the aerosol provision device 20), for example, along data wiring 59*b*, through the electrical connection between the dock 50 and the device 20 at the device port 59, and to the controller 8 of the aerosol provision device 20. The controller 8 of the aerosol provision device 20 in these implementations is configured to obtain the dock status information and generate suitable control signals for controlling the feedback mechanism 24. Alternatively, the controller 55 may, once the dock status information has been obtained, generate suitable control signals for controlling the feedback mechanism 24 of the aerosol provision device 20 and communicate the control signals directly to the aerosol provision device 20 (again, via the data wiring 59*b* and electrical connection between the dock 50 and the device 20 at the device port 59).

Figure 10A:
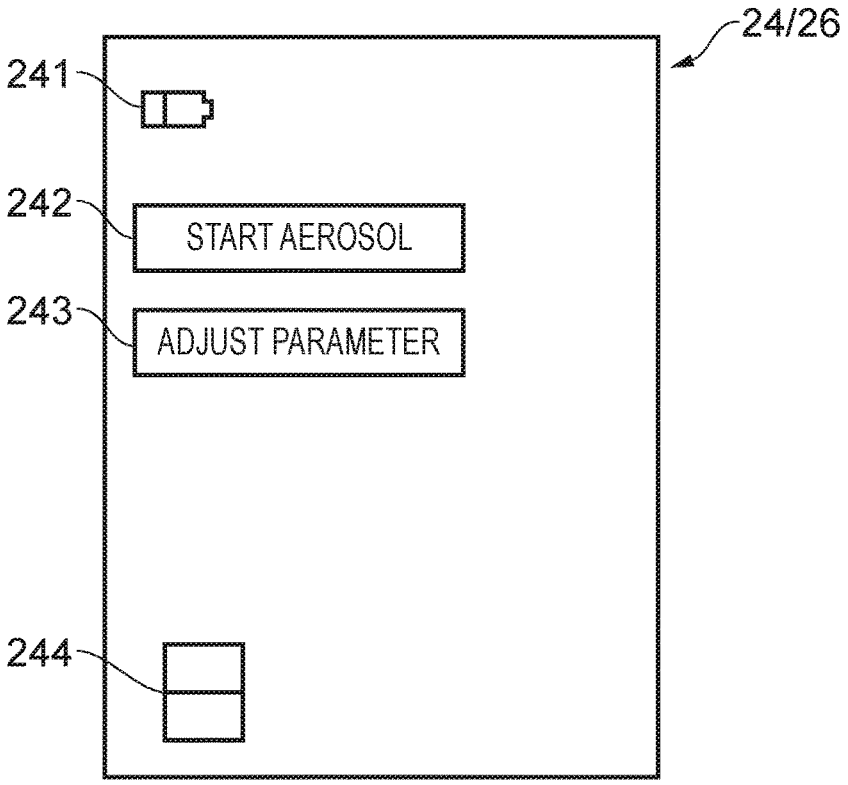
FIGS. 10A and 10B respectively show an example of an feedback mechanism which may be employed in accordance with the principles of the present disclosure where
Figure 10B:
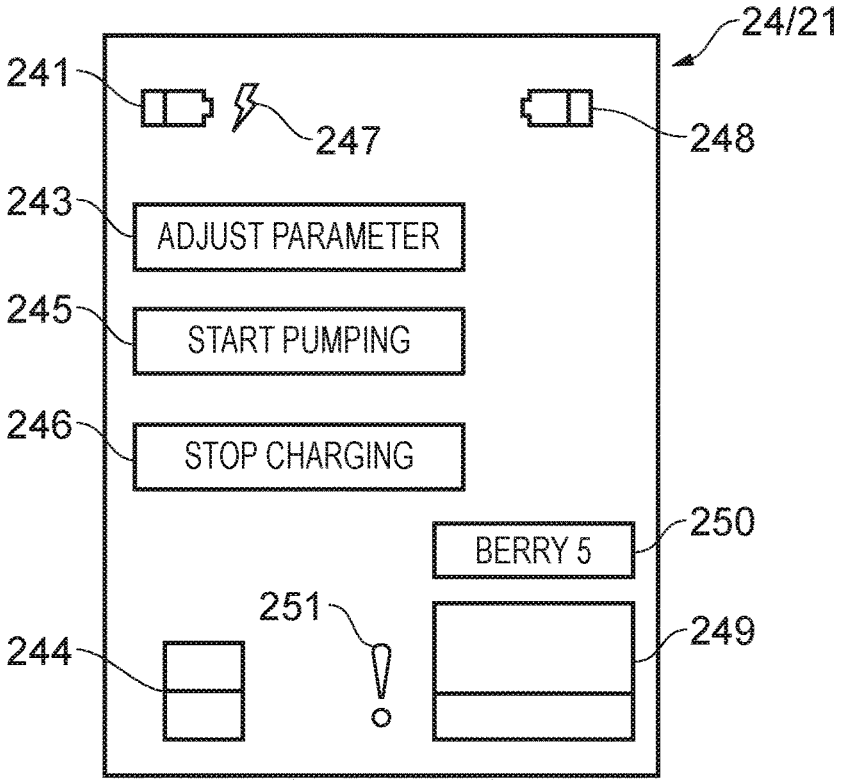

FIGS. 10A and 10B show two example displays which may be displayed on an LCD display or the like acting as a feedback mechanism 24. The LCD display in the example of FIGS. 10A and 10B forms part of a touch screen element designed to receive a user's touch as an input, and therefore the feedback mechanism 24 is also a combined feedback mechanism 24 and user input mechanism 26.

FIG. 10A shows the feedback mechanism presenting a display on the feedback mechanism 24 when the device 20 is not coupled to the dock 50 (in other words, when the device 20 is being used separately from the dock 50, e.g., to generate aerosol from an article 30). The feedback mechanism 24 may include a variety of pieces of feedback. More specifically, the display in FIG. 10A includes: a power source indicator 241 for displaying a current charge level of the power source 7 of the aerosol provision device; a "start aerosol" selectable element 242 which, when selected by the user, provides power to the heater 4 of the article 30; an "adjust parameter" selectable element 243 which, when selected by the user, displays one or more parameters of the aerosol provision system 10 which may be adjusted (e.g., a power supplied to the heater 4); and an article level indicator 244 for displaying a current level of aerosol-generating material within the article 30. Feedback is provided to the user via the indicators 241 and 244 respectively, but feedback regarding the status of the aerosol provision system 20 may also be provided through interacting with the selectable element 243 in particular, whereby selecting the element 243 may cause a list of selectable parameters and currently set values for the parameters. Hence, the feedback mechanism 24 may display all feedback items at once, or the feedback mechanism 24 may display certain feedback items in response to a user input.

FIG. 10B shows the feedback mechanism presenting a display on the feedback mechanism 24 when the device 20 is coupled to the dock 50 via device port 59. As seen in FIG. 10B, the feedback displayed by the feedback mechanism is different compared to the feedback shown in FIG. 10A.

The display of FIG. 10B includes the power source indicator 241, article indicator 244 and selectable element 243 as before. Selectable element 242, however, has been removed due to the fact that the device 20 is now engaged with the dock 50 and therefore no longer able to provide the function of generating aerosol. In this regard, the controller 55 and/or the controller 8 may identify that the device 20 is engaged with the dock 50 and provide control signals indicating to the feedback mechanism 24 to stop displaying the selectable element 242. Selectable element 243 however, when selected, may additionally or alternatively display parameters associated with the dock 50, e.g., parameters of the transfer mechanism 53, such as a pumping rate. The controller 55 may provide the dock status information or suitable control signals which causes the feedback mechanism 24 to display the associated parameters of the dock 50 when the selectable element 243 is selected by a user.

In addition, the display of FIG. 10B shows selectable elements associated with operations of the dock 50, more specifically a "start pumping" selectable element 245 which, when selected by the user, causes the controller 8 and/or the controller 55 to provide control signals to the fluid transfer mechanism 53 to begin transferring aerosol-generating material (in this example, source liquid) to the article 30 from the refill reservoir 40, and a "stop charging" selectable element 246 which, when selected, stops a recharging operation of the dock 50 in respect of power source 7 of the aerosol provision device 20. These selectable elements 245 and 246 may only be displayed to the user once the device 20 is docked with the dock 50, for example, in response to the controller 55 or controller 8 determining the device 20 is docked with the dock 50. The selectable elements 245 and 246, while enabling a user to interact with the dock 50, may additionally provide feedback to the user regarding the status of the refilling and recharging operations. For example, when the recharging or refilling operation has yet to start, the selectable element displays a "start" option (e.g., as shown by selectable element 245), when the recharging or refilling operation has started and is in progress, the selectable element displays a "stop" option (e.g., as shown by selectable element 246), and when the recharging or refilling operation has completed, the selectable element may display a completed message (and hence no longer be selectable by a user). Alternatively, the feedback mechanism 24 may display the associated status of the recharging and/or refilling operation using dedicated icons. For example, as shown in FIG. 10B, an icon 247 in the shape of a lightning bolt may be displayed when the dock 50 is recharging the power source 7 of the aerosol provision device 20 (i.e., during a recharging operation). Additionally displayed on feedback mechanism 24 is a power source 57 indicator 248 for displaying the status of the power source 57 of the dock 50. For example, in implementations when the power source 57 is one or more batteries, the indicator 248 may be a battery indicating the current charge amount of the power source 57. The indicator 248 may alternatively or additionally take the form of a message such as "OK" or "FAIL" to indicate the status of health of the power source 57, e.g., in response to the controller 55 sensing the health of the power source 57. Finally, as well as article indicator 244, FIG. 10B also shows additional information pertaining to the refilling operation of the dock 50. For example, FIG. 10B shows a refill reservoir indicator 249 displaying an amount of aerosol-generating material within the refill reservoir 40 coupled to the dock 50, an aerosol-generating material indicator 250 displaying the type of aerosol-generating material within the refill reservoir 40 (e.g., a flavor and/or strength of nicotine, or more generally active, within the aerosol-generating material), and a low aerosol-generating material warning icon 251 displayed to indicate to the user that the refill reservoir 40 is running low on aerosol-generating material, for instance as detected by the controller 55. Note also that the article indicator 244 may now be controlled by the controller 55 as, unlike in the scenario of FIG. 10A, the article 30 is docked to the dock 50 and thereby the dock 50/controller 55 may sense the amount of aerosol-generating material in the article 30.

As shown in FIGS. 10A and 10B, the feedback mechanism 24 provides certain items of feedback simultaneously to the user but may hide other items of feedback. For instance, and as mentioned, the user may only obtain feedback of the adjustable parameters of the aerosol provision device 20 or dock 50 when selecting the "adjust parameter" selectable element 243. The feedback mechanism 24 may be configured to provide the feedback items simultaneously to the user, sequentially to the user, or a combination of both. If the feedback mechanism 24 is configured to provide the feedback to the user sequentially, the controller 55 or controller 8 may cause the feedback mechanism 24 to operate according to a predefined schedule (e.g., switching between different feedback items every 2-3 seconds) and/or the controller 55 or controller 8 may be configured to switch between feedback items in response to receiving a user input, for instance from user input mechanism 26 (such as selecting a selectable element).

Moreover, while the implementations in FIGS. 10A and 10B generally show implementations in which the feedback is provided exclusively through feedback mechanism 24 and user inputs are received exclusively through user input mechanism 26, it should be appreciated that in certain implementations, feedback may be provided via the dock feedback mechanism 514 and input may be provided via dock user input mechanism 516. For instance, the dock user input mechanism 516 may comprise three user-actuatable buttons, an "up" arrow, a "down" arrow and an "ok" button. The three user-actuatable buttons may be used to navigate through the selectable elements 243, 245, 246 where a selection is made using the "ok" button. This may be particularly useful in situations where the visual feedback element 24 of the device 20 is a not a touch screen and/or no dedicated user input mechanisms for interacting with the feedback mechanism 24 are provided on the device 20. Addition, as an example, certain aspects of feedback may be provided through the dock feedback mechanism 514, e.g., if the dock feedback mechanism comprises a flashing LED which flashes when an error is detected (e.g., an invalid selection using user input mechanism 26).

Generally, it should be appreciated that the feedback mechanism 24 is configured to provide feedback relevant to the status of the dock 50, which may include any relevant parameters associated with operations performed by the dock 50. The specific feedback shown in FIG. 10B (and also in FIG. 10A) is intended to provide examples of the type of feedback that the feedback mechanism 54 may provide to the user and is not to be considered limiting. Indeed, in some implementations, a greater or lesser number of feedback items may be presented to the user, depending on what information is considered relevant to provide to the user. Additionally, as described above, not all items of feedback may be provided via the same mechanism, for instance the low aerosol-generating material warning icon 251 of FIG. 10B may instead be provided via an audio signal.

Figure 11:
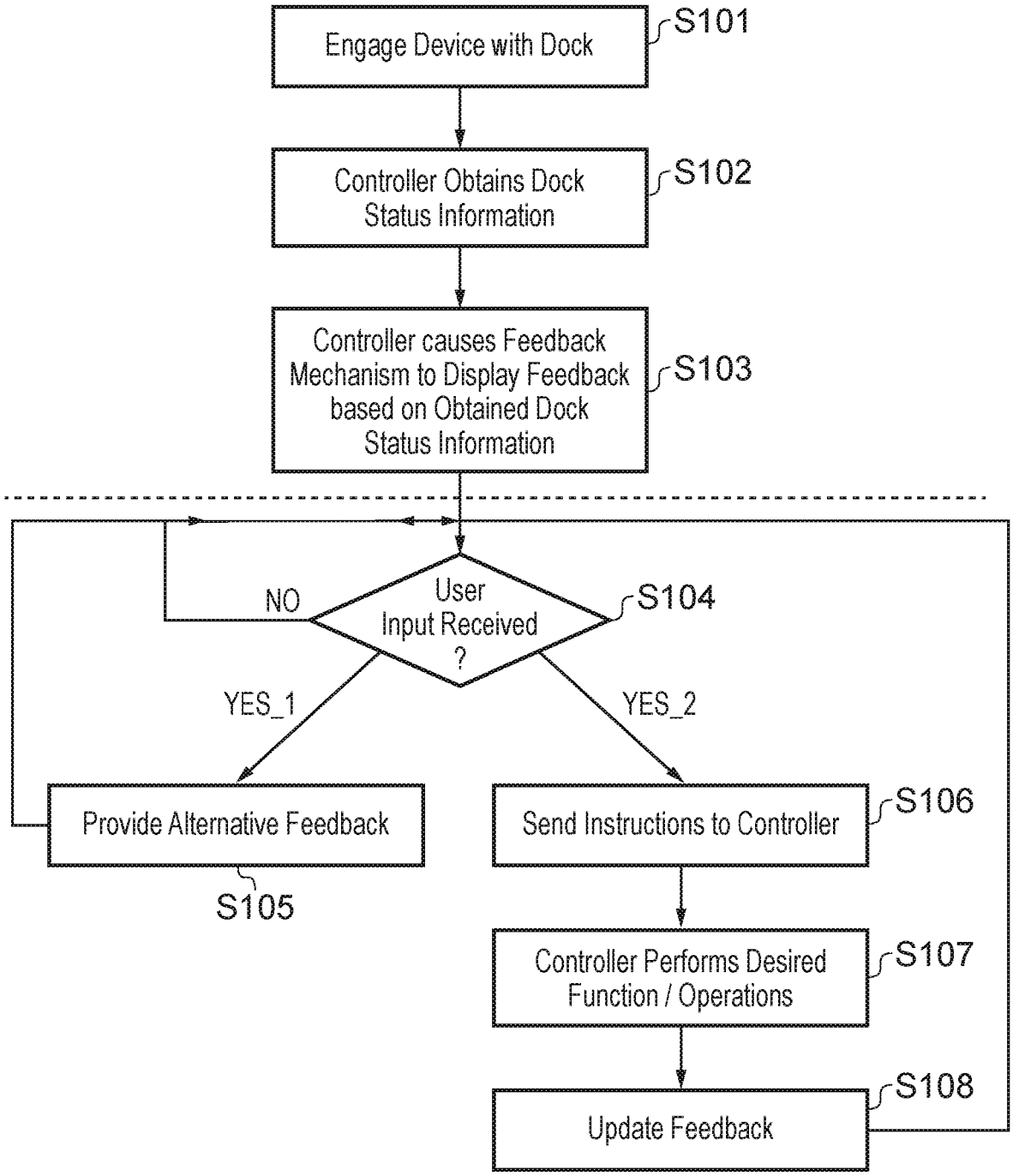
FIG. 11 shows a flow diagram of example method steps for engaging the aerosol provision device with the docking unit and operating the feedback mechanism of the aerosol provision device when engaged with the docking unit.

FIG. 11 is a flow diagram illustrating an example method of providing feedback to a user using the feedback mechanism 24 of the aerosol provision device 20.

The method starts at step S101 where the user engages the aerosol provision device 20 with the dock 50 (or more specifically, the device port 59 of the dock 50). As described above, this involves providing some form of mechanical and, at least, data connection between the dock 50 and the aerosol provision device 20. It should also be appreciated that the article 30 and/or refill reservoir 40 may or may not be engaged with the dock 50, although certain operations (particularly the refilling operation) are not be available if the article 30 and/or refill reservoir 40 are not coupled to the dock 50.

The method proceeds to step S102 where the controller obtains dock status information. As described above, this step of the method may be implemented either by controller 55 of the dock 50 or by controller 8 of the aerosol provision device 20. In the former case, the controller 55 is configured to obtain data pertaining to any of the statuses of the dock 50, for example by measuring any relevant parameters associated with the various statuses. In the latter case, the controller 55 may still obtain or otherwise cause the data pertaining to any of the statuses of the dock 50 to be collected, but subsequently transmits the dock status information to the controller 8 (e.g., via the data wiring 59*b*).

At step S103, the controller 8 or controller 55 causes the feedback mechanism 24 to provide the associated feedback to the user, e.g., via controlling an LCD display to display the associated feedback. In this regard, in the former case, the controller 8, having obtained the dock status information in step S102, generates control signals for controlling the feedback mechanism 24 and provides these control signals to the relevant circuitry in the aerosol provision device 20. In the latter case, the controller 55, having obtained the dock status information in step S102, generates control signals for controlling the feedback mechanism 24 and provides these control signals either directly to the relevant circuitry in the aerosol provision device 20 or to the controller 8. In these cases, it may also be relevant for the controller 55 to receive device status information (i.e., information from the device 20 regarding the status of aspects of the device 20), so as to generate appropriate control signals for controlling the feedback mechanism 24 to additionally provide feedback pertaining to the device 20. Broadly, these two general approaches can be thought of as permitting the controller 8 to be the master controller (in which case data is provided to the controller 8 and controller 8 generates the control signals) or as permitting the controller 55 to be the master controller (in which case data is provided to the controller 55 and controller 55 generates the control signals).

The method may effectively end at this point with the feedback mechanism 24 providing the relevant feedback to the user. It should be appreciated that the steps S102 and S103 may be repeated for the duration of time the device 20 is docked with the dock 50 (that is, the dock status information may continually change, e.g., as a result of performing a refilling operation), and thus the feedback provided by feedback mechanism 24 may be updated continuously or regularly accordingly. If there are a plurality of feedback items to be fed back to the user, the feedback mechanism may provide the feedback simultaneously or sequentially e.g., according to a predefined timing schedule.

However, in implementations where a user input mechanism 26 on the device 20 and/or a user input mechanism 216 on the dock 50 are provided, the method may continue. This is indicated in FIG. 11 by the dashed horizontal line.

At step S104, it is determined whether a user input is received. The user input may be received from either of user input mechanism 26 on the device 20 and/or the dock user input mechanism 216. The method may proceed in a different manner depending on the nature of the user input. If no input is received, i.e., a "NO" at step S104, the method proceeds to repeat step S104 until a user input is received or the device 20 is removed/decoupled from the dock 50.

A first option is for the method to proceed to step S105. In this regard, the user input indicates a user's desire to be provided with additional feedback, and at step S104 the controller 55 or controller 8 determines whether the user input indicates a desire to be provided with additional feedback. If it does, i.e., a "YES_1" at step S104, the method proceeds to step S105. In response to the user input, the feedback mechanism 24 is updated to provide the additional or alternative feedback. For example, as discussed above, in the case of a display screen as a feedback mechanism 24, receiving the user input may cause the display screen to display additional or alternative feedback. For instance, pressing the "adjust parameter" selectable element 243 of FIG. 10B causes additional feedback (e.g., current parameter settings) to be displayed to the user. The method then proceeds back to step S104 to await a further user input.

A second option is for the method to proceed to step S106. In this regard, the user input indicates a user's desire to initiate a function or operation of the dock 50, and at step S104 the controller 55 or controller 8 determines whether the user input indicates a desire to control a function or operation of the dock 50. If it does, i.e., a "YES_2" at step S104, the method proceeds to step S106. In response to the user input, instructions are sent to the controller 55 indicative of the function or operation the user wishes to control and may include how the user wishes to control the function or operation of the dock 50. For instance, the user may select the "start refilling" selectable element of FIG. 10B, in which case the controller 8 may provide a signal to the controller 55 indicating that the user wishes to start the refilling process.

At step S107, the controller 55 receives the instructions in response to the user input and causes the desired function or operation to be controlled in the desired manner, e.g., by causing the transfer mechanism 53 to begin transferring aerosol generating material from the refill reservoir 40 to the article 30.

At step S108, the feedback mechanism 24 is updated to provide updated feedback, in a similar manner to steps S102 and S103. In this case, the feedback will be updated to reflect the function or operation that has been controlled by the user's input. The method may proceed back to step S104 and await a further user input.

Accordingly, and by way of summary, the controller 55 and/or the controller 8 is configured to obtain dock status information indicating the status of the dock 50, and cause the feedback mechanism 24 of the aerosol provision device 20 to provide feedback to the user indicative of the status of the dock 50. The dock status information may include a plurality of statuses regarding different aspects of the dock 50 and, accordingly, the feedback mechanism 24 may be configured to provide feedback pertaining to each or some of the plurality of statuses of the dock 50. The feedback mechanism 24 may provide the feedback simultaneously or sequentially to the user. If the feedback mechanism 24 is configured to provide the feedback to the user sequentially, the controller 55 or controller 8 may cause the feedback mechanism 24 to operate according to a predefined schedule (e.g., switching between feedback items every 2-3 seconds) and/or the controller 55 or controller 8 may be configured to switch between feedback items in response to receiving a user input. The user input may be received via a user input mechanism 12/26 which may or may not be combined with the feedback mechanism 24. The user input may indicate a desire to be provided with additional feedback and/or a desire to interact with the dock 50, e.g., to perform a function or operation of the dock 50.

In accordance with another aspect of the present disclosure, the aerosol provision device comprises a docking unit engagement mechanism for engaging with the docking unit, and the docking unit comprises an aerosol provision device engagement mechanism for engaging with the aerosol provision device; wherein at least one of the docking unit engagement mechanism and aerosol provision device engagement mechanism are configured to enable the aerosol provision device to be engaged with the docking unit in a single orientation. Providing the aerosol provision device in a single orientation relative to the docking unit means that the aerosol provision device is always correctly aligned relative to the docking unit and certain features that may require a certain interaction are provided. In one aspect, the aerosol provision device may be provided with a charging plug/socket which requires alignment with a corresponding socket/plug on the docking unit. Providing the engagement of the aerosol provision device with the dock such that the aerosol provision device can be docked with the docking unit in a single orientation may help to ensure that the corresponding plugs/sockets are aligned correctly each time the aerosol provision device is engaged with the dock. Equally, when the aerosol provision device comprises a feedback mechanism, particularly a visual feedback mechanism, providing the aerosol provision device relative to the docking unit in a single orientation may help ensure the feedback mechanism is not obstructed (e.g., the visual feedback mechanism is visible).

Figure 12A:
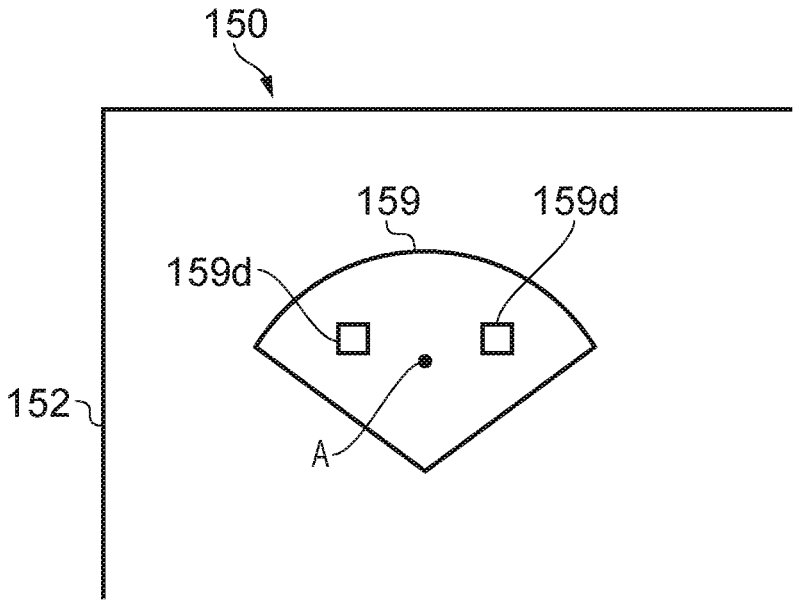
FIGS. 12A and 12B show two different views of a docking unit in accordance with another aspect of the present disclosure, whereby the aerosol provision device is configured to engage with the docking unit in a single orientation.
Figure 12B:
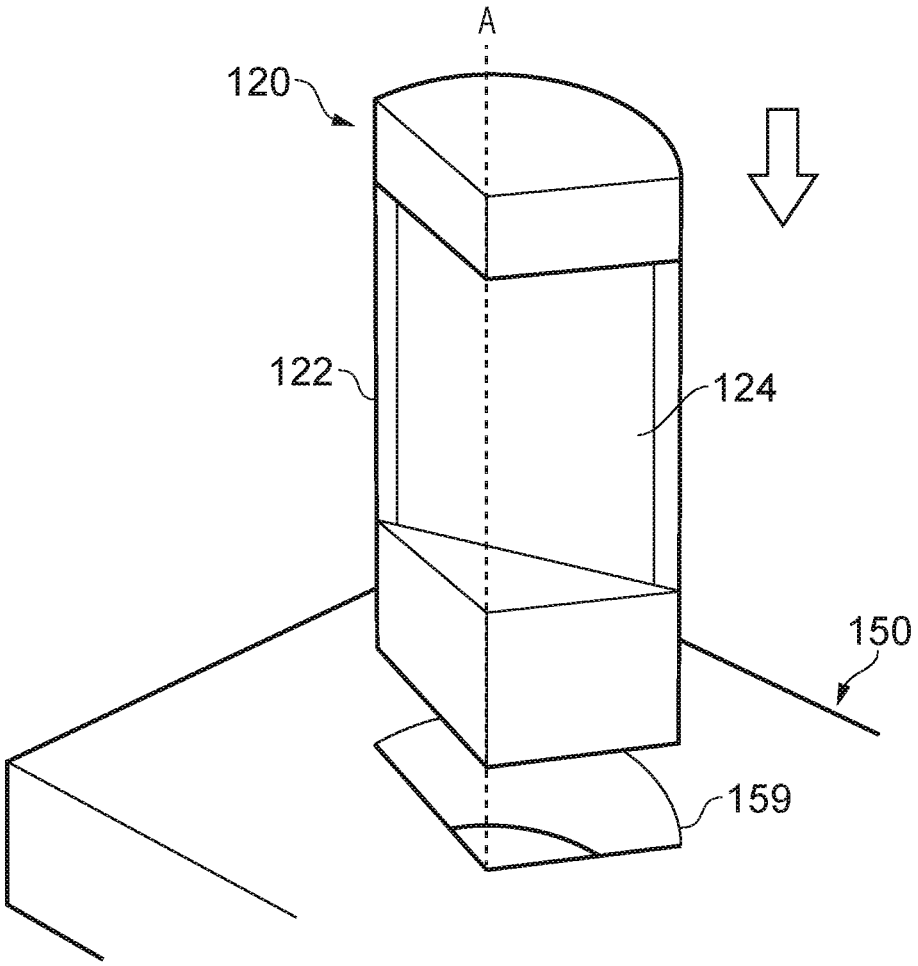

FIGS. 12A and 12B schematically show an example aerosol provision device 120 and dock 150 in accordance with aspects of the present disclosure. The aerosol provision device 120 and dock 150 may be substantially the same as aerosol provision device 20 and dock 50 described in relation to FIGS. 1, 3 and 8 to 11 and may operate in substantially the same way. Only differences between the aerosol provision device 120 and dock 150 with the aerosol provision device 20 and dock 50 described in relation to FIGS. 1, 3 and 8 to 11 are described herein. Additionally, although not shown, a corresponding article is provided which engages with the device 120 (similarly to article 30 above).

FIG. 12A schematically shows a part of dock 150 when viewed from above the dock (similarly to FIG. 9B) while FIG. 12B schematically shows an isometric view of the part of the dock 150 and the aerosol provision device 120. FIG. 12B shows the aerosol provision device 120 separated from the dock 150 (i.e. in a non-docked state).

The dock 150 is broadly similar to the dock 50 described previously except the device port 159 is provided with a certain shape/cross-sectional shape. The device port 159 is, in this regard, formed of a recessed portion within the outer housing 152 of the dock 150. The recessed portion comprises a side wall perpendicularly arranged with a flat base section to form the device port 159. As seen in FIG. 12A, the shape defined by the device port 159 when viewed from above broadly defines an arc connected to two straight lines such that the arc subtends an angle of around 120 to 130°. This shape is an example of a shape which has a singular degree of rotational symmetry about an axis perpendicular to the plane of the defined shape/cross section. For example, taking the axis A shown in FIGS. 12A and 12B, rotating the shape by anything other than 360° (or multiples thereof) does not provide the same shape, in the same position, as prior to the rotation. Conversely, if the shape were a square, then rotating the shape by 90° (or multiples thereof) provides the same shape in the same position (and thus it may be said that a square shape would have four degrees of rotational symmetry about the axis A). In respect of the axis A, the axis A is considered the axis running though the centre of the shape; that is, the axis runs through the centroid or geometric centre of the shape or cross section. While the shape in FIG. 12A defined by the port 159 is an example of a shape having a single degree of rotational symmetry (e.g., with respect to an axis running through the centroid of the shape), many other shapes exist which fulfil this criteria and are therefore suitably covered by the present disclosure.

The aerosol provision device 120 is broadly similar to the aerosol provision device 20 described previously but includes an outer housing 122 having a certain cross-sectional shape. More specifically, the outer housing 122 of the aerosol provision device 120 has a cross-sectional shape corresponding to the cross-sectional shape of the device port 159 such that the outer housing 122 of the device 120 may be, at least partially, received within the device port 159 of the dock 150. Thus, the cross-sectional shape of the aerosol provision device 120 may be the same as the cross-sectional shape of the device port 159 but slightly smaller to facilitate such insertion. The cross-sectional shape of the aerosol provision device 120 is taken along an axis passing through the centroid of the cross-sectional shape of the aerosol provision device 120 and extending longitudinally along the body of the aerosol provision device 120. When the aerosol provision device is engaged with the device port 159, the axis A aligns with the longitudinal axis of the aerosol provision device 120.

Figure 13:
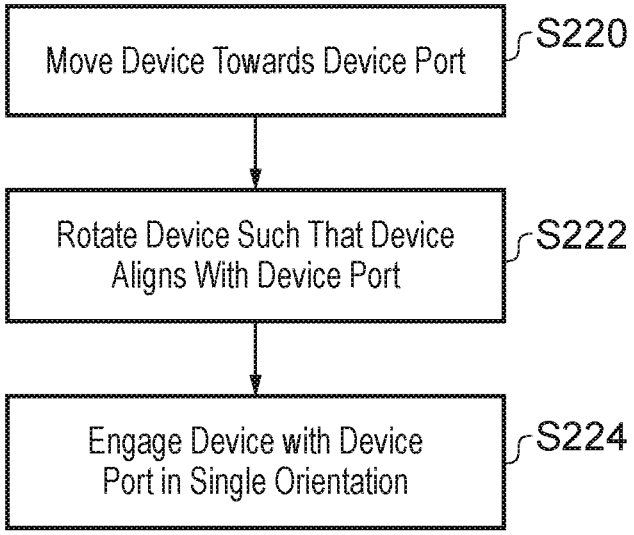
FIG. 13 shows a flow diagram of example method steps for engaging an aerosol provision device with the docking unit in a single orientation.

FIG. 13 shows a flow diagram depicting an example method of coupling the aerosol provision device to the dock.

The method starts at step S220 where the aerosol provision device is moved towards the device port 159 of the dock 150. Taking the example of FIGS. 12B, in order to engage the aerosol provision device 120 with the device port 159, as seen in FIG. 12B, the aerosol provision device 120 is moved in a direction along the longitudinal axis A towards the device port 159 as indicated by the downward arrow. This may be defined as the engagement direction, i.e., the direction of relative movement required to engage the aerosol provision device with the device port 159.

The method proceeds to step S222 where, if required, the user rotates the device 120 about the longitudinal axis such that the cross-sectional shape of the device 120 aligns with the cross-sectional shape of the device port 159. As discussed above, there is only a single orientation that the aerosol provision device 120 will correctly engage with the dock 150 and the user, at step S22, positions the device 120 such that the single orientation is provided. In some implementations, the device port 159 may comprise a lead in feature (e.g., a tapered edge) to help the user guide the aerosol provision device 120 into the device port 159.

The method then proceeds to the final step, S224, where the aerosol provision device 120 is engaged with the device port 159 such that the aerosol provision device 120 is provided in the single orientation relative to the dock 150. In the specific example, the aerosol provision device 120 slots into the device port 159 accordingly. The device port 159 may be termed the aerosol provision device engagement mechanism, while at least a part of the outer surface of the housing 122 of the aerosol provision device 120 may be termed the dock or docking unit engagement mechanism.

It should be appreciated that the steps S220 to S224 of FIG. 13 may comprise step S101 of FIG. 11, or conversely the device 120 and dock 150 may be operated in accordance with steps S102 to S108 of FIG. 11 once the device 120 is docked with the dock 150.

FIG. 12A shows electrical contacts 159*d* provided in the device port 159 which may be correspondingly engaged with contacts in the base of the aerosol provision device 120 (not shown) such that when the aerosol provision device 120 is moved toward and engages with the dock 150, the electrical contacts are brought into alignment. Providing the aerosol provision device 120 and the device port 159 such that the aerosol provision device 120 is only permitted to engage with the dock in a single orientation ensures that the contacts 159*d* and the corresponding contacts on the aerosol provision device 120 can be brought into alignment each time the aerosol provision device 120 is engaged with the dock 50. The electrical contacts 159*d* may be provided for the transfer of power or the exchange of data to/from the aerosol provision device 120.

FIG. 12B further shows the aerosol provision device 120 with a feedback mechanism 124. The feedback mechanism 124 may be substantially the same as feedback mechanism 24 described above. In this example, the feedback mechanism 124 is an LCD display which may or may not have touch-screen functionality. As can be seen, the LCD display is provided on a cut-away section in the housing 122 of the device 120 providing a flat surface for the LCD display to be positioned. When the aerosol provision device 120 is docked into the device port 159, the feedback mechanism 124 (in addition to the aerosol provision device 120) is provided in a single orientation relative to the dock 150. In the example of the visual feedback mechanism 124 of the LCD display, providing the aerosol provision device 120 in a single orientation relative to the dock 150 enables the feedback mechanism 124 to be positioned at the same relative position each time the device 120 is docked with the dock 150. Accordingly, this allows the dock 150 to be designed such that the feedback mechanism 124 is not obstructed when the device 120 is docked. Equally, it allows the user to position the dock 150 in a suitable location, e.g., on a shelf, such that the feedback mechanism 124 is not obstructed (e.g., is visible). In other words, aside from the initial positioning of the dock 150, the user does not have to reposition the dock 150 each time the device 120 is engaged with the dock to ensure that the feedback mechanism 124 is visible.

According to an aspect of the present disclosure, the aerosol provision device comprises a docking unit engagement mechanism for engaging with the docking unit, and the docking unit comprises an aerosol provision device engagement mechanism for engaging with the aerosol provision device, respectively configured such that when engaged with one another, the aerosol provision device is provided in a single orientation.

It should be appreciated that configuring the shape of the device port 159 and at least the part of the housing of the aerosol provision device 120 to have a single degree of rotational symmetry is an example of a device engagement mechanism and a dock engagement mechanism configured to permit the aerosol provision device 120 to be engaged with the dock in a single orientation. The present disclosure may extent to other ways of engaging the device 120 with the dock 150 such that the device 120 is engaged in a single orientation. For example, the outer housing 122 of the aerosol provision device 120 may comprise a protrusion while the device port 159 may comprise a corresponding recess, where the protrusion and recess act as a keying mechanism to help ensure correct alignment of the aerosol provision device 120 relative to the device port 159. The disclosure is not limited to a particular mechanism or shape and other mechanisms and shapes may be utilised in accordance with the present disclosure.

Hence, there has been described a system comprising: an aerosol provision device for generating aerosol from aerosol-generating material; a docking unit for engaging with the aerosol provision device, the docking unit arranged to at least one of: refill an article containing aerosol generating material for use with the aerosol provision device, and recharge a power source of the aerosol provision device, and a controller arranged to obtain status information regarding the status of the docking unit, wherein the aerosol provision device comprises a feedback mechanism arranged to provide feedback to a user; and the controller is configured to cause the feedback mechanism of the aerosol provision device to provide feedback to the user indicative of the status of the docking unit. Also described is an aerosol provision device, a docking unit, a method of displaying feedback to a user, and a system.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A refilling unit for refilling a refillable article for use with an aerosol provision device for generating aerosol from aerosol-generating material stored within the refillable article, the refilling unit comprising:

an article port for receiving at least the article;

an information reader configured to read a readable element for storing information corresponding to the article; and a controller for controlling operations of the refilling unit, wherein the controller is configured to:

determine or obtain an actual usage of the article based on an indication of usage of the article read from the readable element of the article;

determine or obtain an expected usage of the article; and compare the actual usage with the expected usage and, if the actual usage is within a predetermined range of the expected usage, permit the refilling unit to refill the article with aerosol-generating material.

2. The refilling unit of claim 1, wherein when the actual usage is outside of a predetermined range of the expected usage, the refilling unit is configured to prevent refilling of the article with aerosol-generating material.

3. The refilling unit of claim 1, wherein when the actual usage is outside of a predetermined range of the expected usage, the refilling unit is further configured to disable the article such that the article is no longer able to be used to generate aerosol when coupled to an aerosol provision device.

4. The refilling unit of claim 1, wherein when the actual usage is outside of a predetermined range of the expected usage, the refilling unit is configured to cause an alert to be provided to the user of the refilling unit.

5. The refilling unit of claim 1, wherein when the actual usage is outside of a predetermined range of the expected usage, the refilling unit is configured to cause a user account corresponding to a user of the refilling unit and/or of the article to be notified.

6. The refilling unit of claim 1, wherein the indication of usage of the article indicates the amount of aerosol-generating material aerosolised from the article.

7. The refilling unit of claim 1, wherein the indication of usage of the article indicates the amount of aerosol-generating material aerosolised from the article since a previous filling or refilling operation in which the article was supplied with aerosol-generating material.

8. The refilling unit of claim 1, wherein the indication of usage of the article includes a counter value indicative of the number of times an aerosol generator, for generating aerosol from aerosol-generating material, has been activated.

9. The refilling unit of claim 1, wherein the refilling unit is configured to obtain an indication of the current amount of aerosol-generating material within the article, and wherein the expected usage is based on the current amount of aerosol-generating material within the article.

10. The refilling unit of claim 1, wherein the refilling unit is configured to convert the indication of the current amount of aerosol-generating material within the article into the expected usage of the article based, in part, on a mapping between a quantity of aerosol-generating material and an activation of the aerosol generator.

11. The refilling unit of claim 1, wherein the expected usage is based on a previous refill operation.

12. The refilling unit of claim 1, wherein the expected usage is based on the amount of aerosol-generating material transferred to the article during a previous refill operation.

13. The refilling unit of any of claims 1 to 12, wherein the predetermined range is either an absolute value or a relative value of the amount of expected usage.

14. The refilling unit of claim 1, wherein the refilling unit is configured to update the indication of usage stored by the readable element of the article in response to initiation or completion of a refill operation.

15. The refilling unit of claim 14, wherein the refilling unit is configured to reset the indication of usage stored by the readable element.

16. A system comprising the refilling unit of claim 1 and a refillable article comprising:

a storage area for storing aerosol-generating material;

a readable element for storing information corresponding to the article; and an indication of usage of the article stored in the readable element, wherein the indication of usage is indicative of the amount of aerosol-generating material aerosolised by the article since a previous filling or refilling operation in which the article is supplied with aerosol-generating material, and wherein the refillable article is configured to releasably engage with the refilling unit.

* * * * *